US011828108B2

(12) United States Patent
Crockett et al.

(10) Patent No.: US 11,828,108 B2
(45) Date of Patent: Nov. 28, 2023

(54) ANGLED CHISEL INSERT

(71) Applicant: Schlumberger Technology Corporation, Sugar Land, TX (US)

(72) Inventors: Ronald B. Crockett, Provo, UT (US); Dwain Norris, Provo, UT (US); Aaron Madsen, Provo, UT (US); Neil Cannon, Woodland Hills, UT (US); John Daniel Belnap, Lindon, UT (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 393 days.

(21) Appl. No.: 16/069,689

(22) PCT Filed: Jan. 11, 2017

(86) PCT No.: PCT/US2017/012895
§ 371 (c)(1),
(2) Date: Jul. 12, 2018

(87) PCT Pub. No.: WO2017/123562
PCT Pub. Date: Jul. 20, 2017

(65) Prior Publication Data

US 2019/0010763 A1 Jan. 10, 2019

Related U.S. Application Data

(60) Provisional application No. 62/338,713, filed on May 19, 2016, provisional application No. 62/278,116, filed on Jan. 13, 2016.

(51) Int. Cl.

| | |
|---|---|
| ***E21B 10/567*** | (2006.01) |
| ***E21C 35/183*** | (2006.01) |
| ***E01C 23/088*** | (2006.01) |

(52) U.S. Cl.
CPC ..... *E21B 10/5673* (2013.01); *E21C 35/183* (2013.01); *E01C 23/088* (2013.01); *E21C 35/1837* (2020.05)

(58) Field of Classification Search
CPC ..... E21B 10/5673; E21C 35/183; E21C 35/1837; E21C 23/088
See application file for complete search history.

(56) References Cited

U.S. PATENT DOCUMENTS

| | | | |
|---|---|---|---|
| 1,649,858 | A | 11/1927 | Reed et al. |
| 2,578,593 | A | 12/1951 | Orville et al. |

(Continued)

FOREIGN PATENT DOCUMENTS

| | | | |
|---|---|---|---|
| CN | 201513124 | U | 6/2010 |
| EP | 0154936 | A2 | 9/1985 |

(Continued)

OTHER PUBLICATIONS

International Search Report and Written Opinion issued in International Patent application PCT/US2017/012895 dated May 18, 2017, 15 pages.

(Continued)

*Primary Examiner* — Christopher J Sebesta
*Assistant Examiner* — Neel Girish Patel
(74) *Attorney, Agent, or Firm* — Jeffrey D. Frantz

(57) ABSTRACT

A cutting element includes a substrate that is axially symmetric about a central axis. The substrate has a radius perpendicular to the central axis and that extends from the central axis to an outer surface of the substrate. A super-hard material is coupled to the substrate, and the central axis passes through the super-hard material. The super-hard material has an external surface defining at least one ridge protruding from a remainder of the external surface. A central point on the central axis is offset from the external (Continued)

surface of the super-hard material by a distance equal to the radius of the substrate. A distance measured from the external surface of the super-hard material to the central point is greatest at a position between 25° and 45° from the central axis of the substrate.

17 Claims, 17 Drawing Sheets

(56) References Cited

U.S. PATENT DOCUMENTS 2,990,025 A 6/1961 Talbert et al.
3,388,757 A 6/1968 Fittinger et al.
3,442,342 A 5/1969 McElya et al.
3,542,142 A 11/1970 Hasiba et al.
3,599,737 A 8/1971 Fischer et al.
3,946,820 A 3/1976 Knapp
4,056,153 A 11/1977 Miglierini
4,058,177 A 11/1977 Langford, Jr. et al.
4,086,973 A 5/1978 Keller et al.
4,108,260 A 8/1978 Bozarth
4,162,900 A 7/1979 Judd
4,190,126 A 2/1980 Kabashima
4,254,840 A 3/1981 Shay, Jr.
4,271,917 A 6/1981 Sahley
4,334,586 A 6/1982 Schumacher
4,352,400 A 10/1982 Grappendorf et al.
4,511,006 A 4/1985 Grainger
4,518,888 A 5/1985 Zabcik
4,586,574 A 5/1986 Grappendorf
4,716,977 A 1/1988 Huffstutler
4,722,405 A 2/1988 Langford, Jr.
4,811,801 A 3/1989 Salesky et al.
4,832,139 A 5/1989 Minikus et al.
4,854,405 A 8/1989 Stroud
4,940,099 A 7/1990 Deane et al.
4,951,762 A 8/1990 Lundell
D324,527 S 3/1992 Slutz
5,131,478 A 7/1992 Brett et al.
5,172,777 A 12/1992 Siracki et al.
5,172,779 A 12/1992 Siracki et al.
5,197,555 A 3/1993 Estes
5,201,376 A 4/1993 Williams
5,303,787 A 4/1994 Brady
5,322,138 A 6/1994 Siracki
5,323,865 A 6/1994 Isbell et al.
5,341,890 A 8/1994 Cawthorne et al.
5,351,768 A 10/1994 Scott et al.
5,372,210 A 12/1994 Harrell
5,379,854 A * 1/1995 Dennis ..... E21B 10/5673 51/307
5,407,022 A 4/1995 Scott et al.
5,415,244 A 5/1995 Portwood
5,421,423 A 6/1995 Huffstutler
5,421,424 A 6/1995 Portwood et al.
5,429,199 A 7/1995 Sheirer et al.
5,429,200 A 7/1995 Blackman et al.
5,452,771 A 9/1995 Blackman et al.
5,479,997 A 1/1996 Scott et al.
5,518,077 A 5/1996 Blackman et al.
5,533,582 A 7/1996 Tibbitts
5,535,839 A 7/1996 Brady
5,542,485 A 8/1996 Pessier et al.
5,560,440 A 10/1996 Tibbitts
5,592,995 A 1/1997 Scott et al.
5,630,479 A 5/1997 Dennis
5,636,700 A 6/1997 Shamburger, Jr.
5,644,956 A 7/1997 Blackman et al.
5,695,019 A 12/1997 Shamburger, Jr.
5,697,462 A 12/1997 Grimes et al.
5,709,278 A 1/1998 Crawford
5,743,346 A 4/1998 Flood et al.
5,746,280 A 5/1998 Scott et al.
5,752,573 A 5/1998 Scott et al.
5,755,301 A 5/1998 Love et al.
5,813,485 A 9/1998 Portwood
5,819,861 A 10/1998 Scott et al.
5,833,020 A 11/1998 Portwood et al.
5,839,526 A 11/1998 Cisneros et al.
5,871,060 A * 2/1999 Jensen ..... E21B 10/5673 175/420.2
5,881,828 A 3/1999 Fischer et al.
5,887,655 A 3/1999 Haugen et al.
5,887,668 A 3/1999 Haugen et al.
5,890,550 A 4/1999 Swadi et al.
5,915,486 A 6/1999 Portwood et al.
5,950,745 A 9/1999 Ingmarsson
5,967,245 A 10/1999 Garcia et al.
6,029,759 A 2/2000 Sue et al.
6,053,263 A 4/2000 Meiners
6,059,054 A 5/2000 Portwood et al.
6,105,693 A 8/2000 Ingmarsson
6,105,694 A 8/2000 Scott
D430,578 S 9/2000 Brady
6,135,219 A 10/2000 Scott
6,148,938 A 11/2000 Beaton
6,161,634 A 12/2000 Minikus et al.
6,176,332 B1 1/2001 Massa et al.
6,176,333 B1 1/2001 Doster
6,196,340 B1 3/2001 Jensen et al.
6,199,645 B1 * 3/2001 Anderson ..... E21B 17/1092 175/428
6,202,752 B1 3/2001 Kuck et al.
6,241,034 B1 6/2001 Steinke et al.
6,241,035 B1 6/2001 Portwood
6,290,008 B1 9/2001 Portwood et al.
6,367,568 B2 4/2002 Steinke et al.
6,419,034 B1 7/2002 Belnap et al.
6,427,791 B1 8/2002 Glowka et al.
6,510,910 B2 1/2003 Eyre et al.
6,527,069 B1 * 3/2003 Meiners ..... E21B 10/567 175/432
6,530,441 B1 3/2003 Singh et al.
6,561,293 B2 5/2003 Minikus et al.
6,595,305 B1 7/2003 Dunn et al.
6,601,662 B2 8/2003 Matthias et al.
6,745,645 B2 6/2004 Griffo
6,782,959 B2 8/2004 Minikus et al.
6,861,061 B2 3/2005 Maxon et al.
6,883,624 B2 4/2005 McDonough
6,929,079 B2 8/2005 McDonough et al.
7,013,999 B2 3/2006 Tufts
7,040,424 B2 5/2006 Yong et al.
7,152,703 B2 12/2006 Meiners et al.
7,353,893 B1 4/2008 Hall et al.
7,384,105 B2 6/2008 Hall et al.
7,469,756 B2 12/2008 Hall et al.
7,631,709 B2 12/2009 McDonough et al.
7,686,106 B2 3/2010 Baker et al.
7,699,126 B2 4/2010 Boudrare et al.
7,726,420 B2 6/2010 Shen et al.
7,743,855 B2 6/2010 Moss
7,757,785 B2 7/2010 Zhang et al.
7,757,789 B2 7/2010 Yong et al.
7,798,258 B2 9/2010 Singh et al.
7,950,476 B2 5/2011 McDonough et al.
8,028,774 B2 10/2011 Hall et al.
8,061,457 B2 11/2011 Hall et al.
8,122,980 B2 2/2012 Hall et al.
8,172,011 B2 5/2012 Tank
8,763,731 B2 7/2014 Scott et al.
2002/0108789 A1 8/2002 Schautt
2003/0034179 A1 2/2003 Singh
2004/0163851 A1 * 8/2004 McDonough ..... E21B 10/5673 175/426
2004/0173384 A1 9/2004 Yong et al.
2005/0023043 A1 * 2/2005 Tufts ..... E21B 10/52 175/426
2005/0189149 A1 9/2005 McDonough
2005/0247492 A1 11/2005 Shen et al.
2006/0027399 A1 2/2006 Holte et al.
2006/0283639 A1 12/2006 Yong et al.

(56) References Cited

U.S. PATENT DOCUMENTS

| | | | | |
|---|---|---|---|---|
| 2007/0084640 | A1* | 4/2007 | Singh | E21B 10/5673 175/430 |
| 2007/0095577 | A1 | 5/2007 | Griffo et al. | |
| 2008/0035387 | A1 | 2/2008 | Hall et al. | |
| 2008/0060852 | A1 | 3/2008 | Chandila et al. | |
| 2008/0156542 | A1 | 7/2008 | Baker et al. | |
| 2008/0156543 | A1* | 7/2008 | McDonough | E21B 10/16 175/336 |
| 2010/0059286 | A1* | 3/2010 | McDonough | E21B 10/52 175/430 |
| 2010/0059287 | A1 | 3/2010 | Durairajan et al. | |
| 2011/0031032 | A1* | 2/2011 | Mourik | C22C 26/00 175/428 |
| 2014/0182947 | A1 | 7/2014 | Bhatia et al. | |
| 2015/0259988 | A1 | 9/2015 | Chen et al. | |
| 2018/0274303 | A1* | 9/2018 | Song | E21B 10/55 |

FOREIGN PATENT DOCUMENTS

| | | | | |
|---|---|---|---|---|
| EP | 0391683 | A1 | 10/1990 | |
| EP | 0446765 | A1 | 9/1991 | |
| EP | 0527506 | A2 | 2/1993 | |
| EP | 0902159 | A2 | 3/1999 | |
| EP | 1182325 | A1 * | 2/2002 | E21B 10/573 |
| FR | 2620487 | A1 | 3/1989 | |
| GB | 2361497 | A | 10/2001 | |
| GB | 2369841 | A | 6/2002 | |
| GB | 2375126 | A | 11/2002 | |
| GB | 2393982 | A | 4/2004 | |
| GB | 2398330 | A | 8/2004 | |
| RU | 2105124 | C1 | 2/1998 | |
| RU | 2153569 | C2 | 7/2000 | |
| WO | WO0161142 | A1 | 8/2001 | |
| WO | 2011139903 | A2 | 11/2011 | |

OTHER PUBLICATIONS

Office Action issued in U.S. Appl. No. 14/138,208 dated Dec. 29, 2016, 19 pages.

Office Action issued in U.S. Appl. No. 14/138,208 dated Jun. 17, 2016, 19 pages.

First Office Action and Search Report issued in Chinese patent application 2017800065760 dated Sep. 18, 2019, 20 pages.

International Preliminary Report on Patentability issued in International Patent application PCT/US2017/012895 dated Jul. 26, 2018, 12 pages.

Exam Report issued in Canadian Patent Application No. 3011347 dated Feb. 7, 2023, 5 pages.

* cited by examiner

ANGLED CHISEL INSERT

CROSS-REFERENCE TO RELATED APPLICATIONS

This application claims the benefit of, and priority to, U.S. Patent Application No. 62/278,116, filed Jan. 13, 2016 and to U.S. Patent Application No. 62/338,713, filed May 19, 2016, which applications are expressly incorporated herein by this reference in their entireties.

BACKGROUND

In various fields such as earth-boring, road milling, mining and trenching it is often desirable to engage and degrade tough materials such as rock, asphalt, or concrete. To do so, cutting elements may be coupled to a movable body that may bring the cutting elements into contact with a material to be degraded as the body moves. For example, when exploring for or extracting subterranean oil, gas, or geothermal energy deposits, a plurality of cutting elements can be secured to a drill bit attached to the end of a drill sting. As the drill bit is rotated, the cutting elements may degrade a subterranean formation forming a wellbore, which allows the drill bit to advance through the formation. In another example, when preparing an asphalt road for resurfacing, cutting elements can be coupled to tips of picks that may be connected to a rotatable drum. As the drum is rotated, the cutting elements may degrade the asphalt leaving a surface ready for application of a fresh layer.

The cutting elements used in such applications often include super-hard materials, such as polycrystalline diamond, sintered to a substrate material in a high-pressure, high-temperature environment. These cutting elements, like those described in U.S. Pat. No. 7,726,420 to Shen et al., may include a cutting edge formed in the super-hard material designed to scrape against and shear away a surface. While effective in cutting formation or other materials, such cutting elements may be susceptible to chipping, cracking, or partial fracturing when subjected to high forces.

BRIEF SUMMARY

In accordance with some embodiments, a cutting element includes a substrate that is axially symmetric about a central axis thereof. The substrate has a radius perpendicular to the central axis and which extends from the central axis to an outer surface of the substrate. A super-hard material is coupled to the substrate, and the central axis passes through the super-hard material. The super-hard material has an external surface defining at least one ridge protruding from a remainder of the external surface. A central point on the central axis is offset from the external surface of the super-hard material by a distance equal to the radius of the substrate. A distance measured from the external surface of the super-hard material to the central point is greatest at a position between 25° and 45° from the central axis of the substrate.

According to some embodiments, a cutting element may include a substrate that is axially symmetric about its central axis. A super-hard material may be bonded to a side of the substrate such that the central axis passes through the super-hard material. An external surface of the super-hard material may include a geometry designed to increase the cutting element's resistance to high forces. Specifically, a distance, measured from the external surface of the super-hard material to a central point, may be greatest at an angle from the central axis of the substrate. The central point may be located on the central axis and sit a length from the external surface along the central axis equal to a radius of the substrate.

In further example embodiments, an external surface of the super-hard material may include a ridge protruding from a remainder of the external surface. In various embodiments, the ridge may intersect the central axis of the substrate, be generally perpendicular to the central axis of the substrate, or be generally convex over a maximum length thereof. In some embodiments, a plurality of ridges may extend from a common center that may fall on the central axis of the substrate with the ridges equally spaced around the common center. In some embodiments, the distance measured from the external surface of the super-hard material to the central point is greatest at more than one positions optionally between 25° and 45° from the central axis of the substrate.

A thickness of the super-hard material may also be designed to increase the cutting element's resistance to high forces. For instance, a thickness, measured from the external surface of the super-hard material to an interface between the super-hard material and the substrate along a line passing through the central point, may be greatest at a position between 25° and 45° from the central axis of the substrate. Beyond this position between 25° and 45° from the central axis of the substrate, a portion of the external surface may take the form of part of a cone shape or ogive shape. Additionally, a boundary between the ridge and the cone shape or ogive shape may include a chamfer.

In some embodiments, the substrate may have an elevated portion protruding into the super-hard material and extending radially to a position between 25° and 45° from the central axis of the substrate from the central point. In some embodiments, a thickness of a transition region between the super-hard material and the substrate may have a substantially constant thickness regardless of thickness of the super-hard material.

A cutting element of the present disclosure may be coupled to a drill bit or pick. When secured to a drill bit or pick, to control the aggressiveness of each cutting element, a ridge on each cutting element may be positioned between 0° and 70° relative to a formation. Further, the ridge on each cutting element may be positioned parallel, non-parallel, or perpendicular to a direction of rotation.

DETAILED DESCRIPTION

Figure 1:
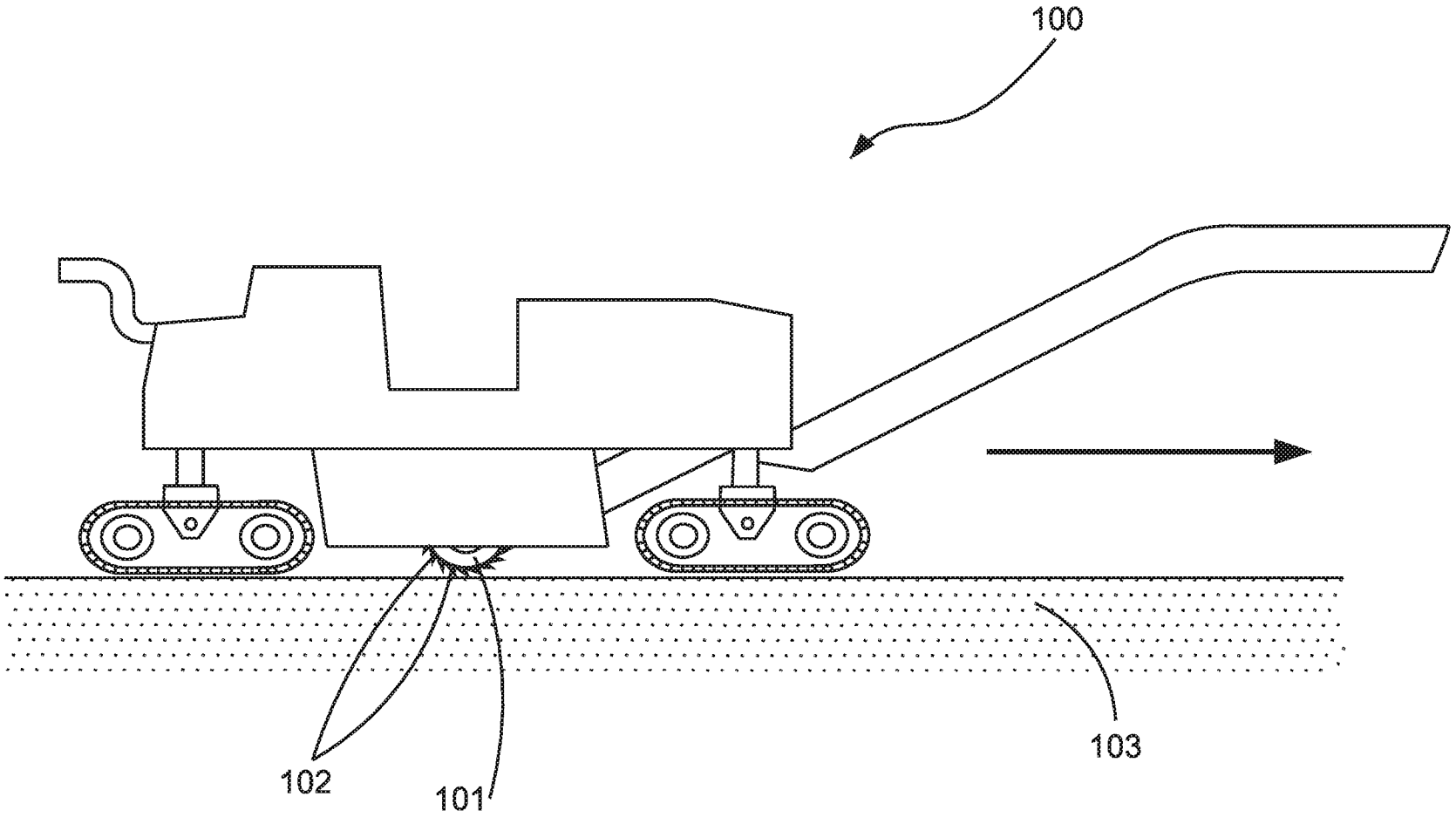
FIG. 1 is a side view of a road milling machine performing a road milling operation, according to some embodiments of the present disclosure.

FIG. 1 shows an embodiment of a road milling machine 100 that may be used in a road milling operation that may be used when preparing a road 103 for resurfacing. The road milling machine 100 may include a plurality of picks 102 connected to a rotatable drum 101. As the rotatable drum 101 is rotated, the picks 102 may engage and degrade the road 103, thereby leaving a surface ready for application of a fresh layer of gravel, asphalt, or some other material.

Figure 2:
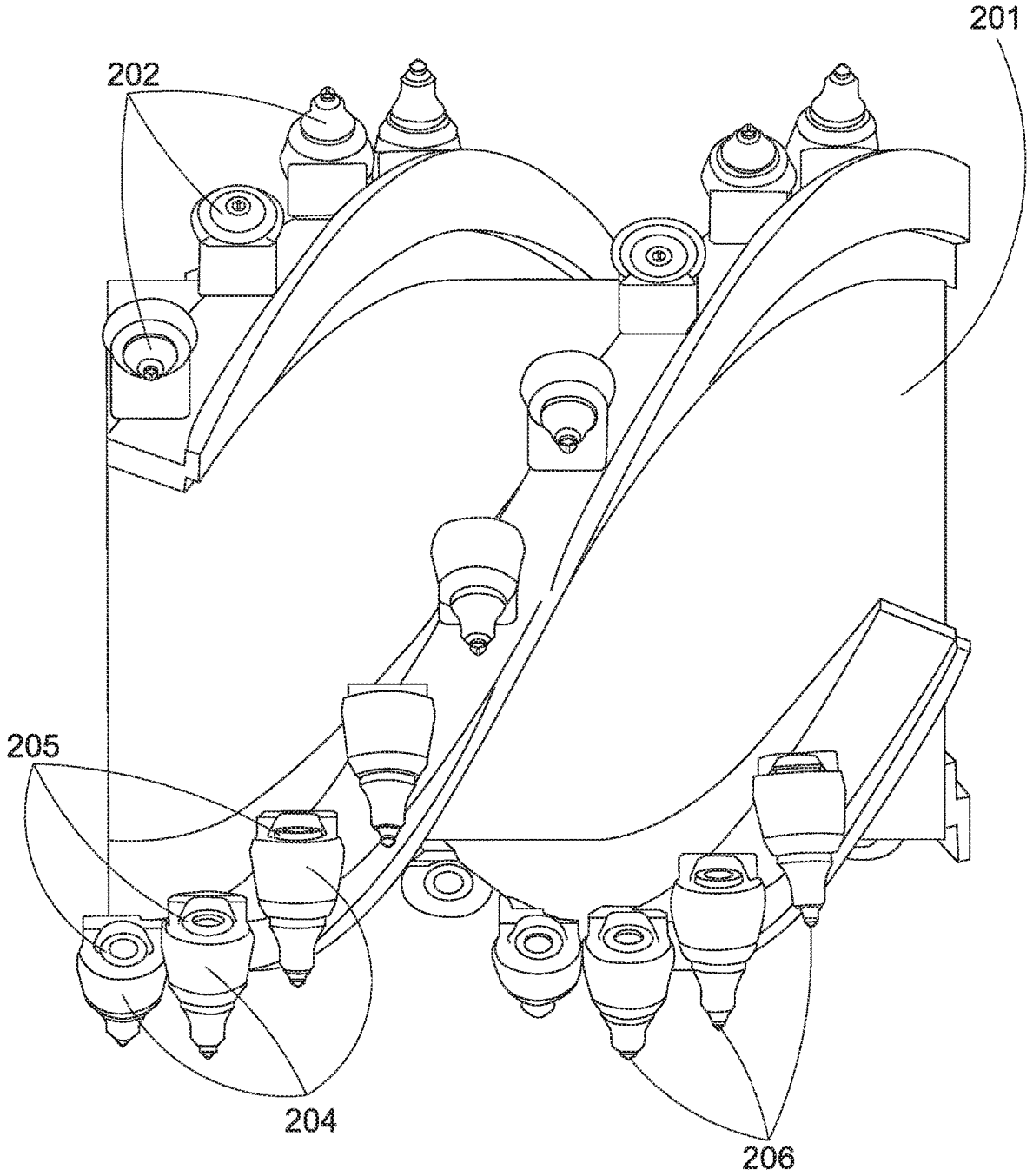
FIG. 2 is a front view of a rotatable drum including a plurality of picks, according to some embodiments of the present disclosure.

FIG. 2 shows an embodiment of a rotatable drum 201 with a plurality of picks 202 arranged in a helical pattern around a circumference or outer surface of the rotatable drum 201. Each of the picks 202 may include a shank 205 that is optionally be inserted into a bore of an individual block 204 and which may be retained therein by friction, mechanical fasteners, or some other fastening means. Each of the plurality of picks 202 may include a hardened tip 206 opposite the shank 205. The hardened tip 206 may include materials, geometry, or other features such that the hardened tip 206 is arranged or otherwise configured to degrade a material engaged by the hardened tip 206. For instance, the rotatable drum 201 and the plurality of picks 202 may be used in the road milling machine 100 of FIG. 1, and used to degrade a road (e.g., road 103 of FIG. 1).

Figure 3A:
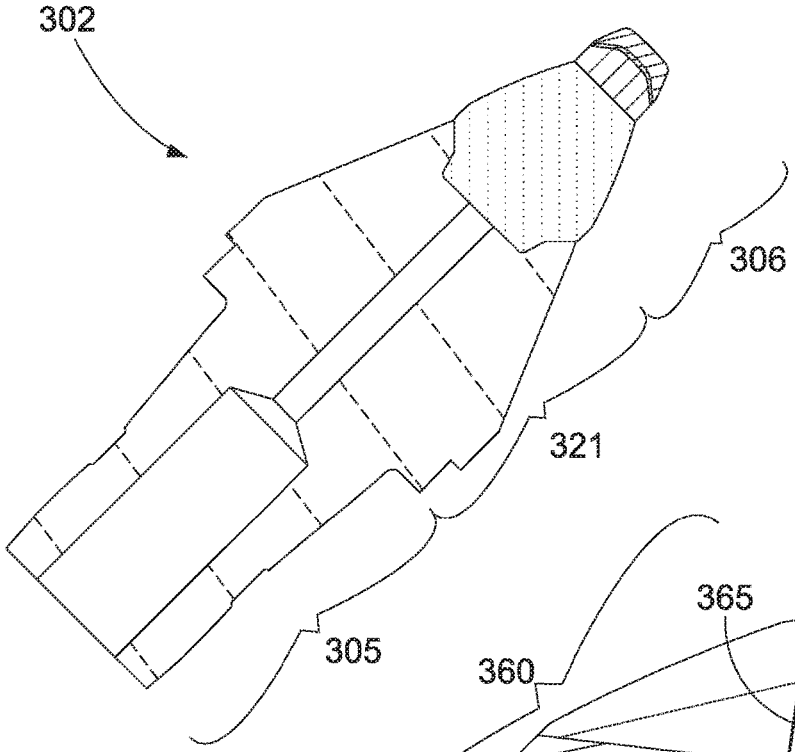
FIG. 3*a* is a longitudinal cross-sectional view of a pick with a cutting element on a tip thereof, according to some embodiments of the present disclosure.

FIG. 3*a* is a cross-sectional view of an example pick 302 that is optionally used in connection with the rotatable drum 101 of FIG. 1 or rotatable drum 201 of FIG. 2. The pick 302 may include a generally frustoconical body 321 with a shank 305 extending from a base thereof. A hardened tip 306 may also extend from an upper end portion of the frustoconical body 321 and in a direction that is generally opposite the shank 305. An uppermost portion of the hardened tip 306 of FIG. 3*a* is shown in the enlarged view of FIG. 3*b*, which illustrates the hardened tip 306 as including a cutting element 360 secured to a distal end thereof. The cutting element 360 may include a substrate 361 that is axially symmetrical about a central axis 362 thereof. A super-hard material 363 (e.g., polycrystalline diamond, cubic boron nitride, etc.) may be bonded, adhered, or otherwise coupled to the substrate 361, such that the axis 362 passes through the super-hard material 363. Optionally, the super-hard material 363 is coupled to the uppermost end or side of the substrate 361, and thus opposite the shank 305 of the pick 302 (see FIG. 3*a*).

In some embodiments, an external surface of the super-hard material 363 may include or define a ridge 370 or other feature that is generally perpendicular to the axis 362. A central point 364 may be identified at a position along the axis 362 at a distance from an external surface of the super-hard material 363 that is equal to the distance between the axis 362 and the outer surface of the substrate 361. For instance, the central point 364 may be on the axis 362 and axially offset from the ridge 370 by a distance equal to the radius (or half-width) of the substrate 361. In some embodiments, a greatest distance 365 measured from an external surface of the super-hard material 363 to the central point 364 may be oriented at an angle 366 from the axis 362. In some embodiments, the angle 366 may be between 10° and 60°. For instance, the angle 366 may be within a range having lower, upper, or both lower and upper limits including any of 10°, 20°, 25°, 30°, 40°, 45°, 50°, 60°, and values therebetween. In particular examples, the angle 366 may be between 20° and 50°, between 25° and 45°, or between 30° and 40°. In still other embodiments, the angle 366 may be less than 25° or greater than 45°.

As can be seen in the illustrated embodiment, the greatest distance 365 may optionally be found at more than one point around a perimeter of the super-hard material 363. In at least some embodiments, including multiple locations at which the greatest distance 365 is present may allow for the super-hard material 363 to have one, two, or more axes of symmetry, or otherwise be re-usable. For instance, the cutting element 360 may be used to degrade a material with the cutting element 360 in an orientation that primarily uses a portion of the cutting element 360 associated with one point having the greatest distance 365. Thereafter, the cutting element 360, hardened tip 306, or pick 302 may be removed and rotated to expose a fresh section of the ridge 370 (e.g., in the event the first cutting portion chips, cracks, dulls, etc.).

The thickness of the super-hard material 363 may be measured from the external surface of the super-hard material 363 to an interface between the super-hard material 363 and the substrate 361, along a line passing through the central point 364. In some embodiments, the thickness of the super-hard material 363 may be constant within the super-hard material 363. In other embodiments, the thickness may vary. For instance, a thickness of the super-hard material 363 is optionally greatest along the line defining the greatest distance 365. In other embodiments, the thickness of the super-hard material 363 may be greatest along a line that is offset from the line defining the greatest distance 365. In at least some embodiments, the thickness of the super-hard material 363 is greatest along a line between 0° and 90° from the axis 362. For instance, the angle of the line associated with the greatest thickness may be within a range having lower, upper, or both lower and upper limits including any of 0°, 15°, 25°, 35°, 45°, 55°, 60°, 75°, 90°, and values therebetween. In particular examples, such an angle may be between 15° and 75°, between 25° and 45°, or between 30° and 40°.

Figure 3B:
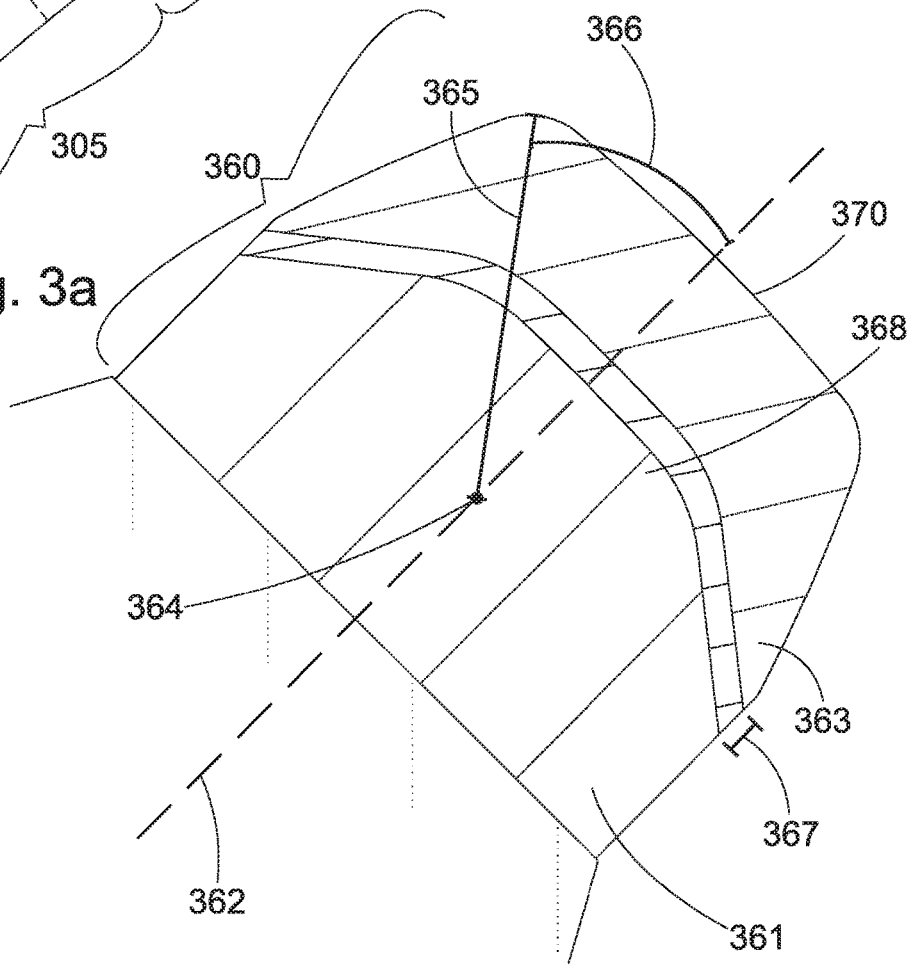
FIG. 3*b* is an enlarged view of the cutting element of FIG. 3*a*.

In some embodiments, the ridge 370 may have a generally constant height, such that the outer edge in the cross-sectional view in FIG. 3*b* is generally linear. In some embodiments, the ridge 370 may transition to one or more side surfaces extending toward the substrate 361. Optionally, the transition between the side surfaces and the ridge 370 may be abrupt/discontinuous (e.g., two linear portions meeting at an angle or corner), or continuous (e.g., a curved, gradual transition). In some embodiments, the ridge 370 may have a variable height. For instance, the ridge 370 may be convexly or concavely curved, or a linear edge may have a variable height.

As can also be seen in the embodiment shown in FIG. 3*b*, a transition zone 367 may be present at the interface between the substrate 361 and the super-hard material 363. Optionally, the thickness of the transition zone 367 may be generally constant, regardless of the thickness of the super-hard material 363. In other embodiments, the transition zone 367 may have a variable thickness (e.g., thicker at a thicker portion of the super-hard material 363).

In some embodiments, the substrate 361 may include an elevated portion 368. The elevated portion 368 may protrude into the super-hard material 363, such that a radial line perpendicular to the axis 362 would extend through at least a portion of the super-hard material 363. In some embodiments, the elevated portion 368 extends radially to a position between 0° and 90° from the axis 362 of the substrate 361 as measured from the central point 364. For instance, the elevated portion 368 may extend radially to an angular position that is within a range having lower, upper, or both lower and upper limits including any of 0°, 15°, 25°, 35°, 45°, 55°, 60°, 75°, 90° and values therebetween, from the axis 362 of the substrate 361, as measured from the central point 364. In particular examples, such an angle may be between 15° and 75°, between 25° and 45°, or between 30° and 40°.

Figure 4A:
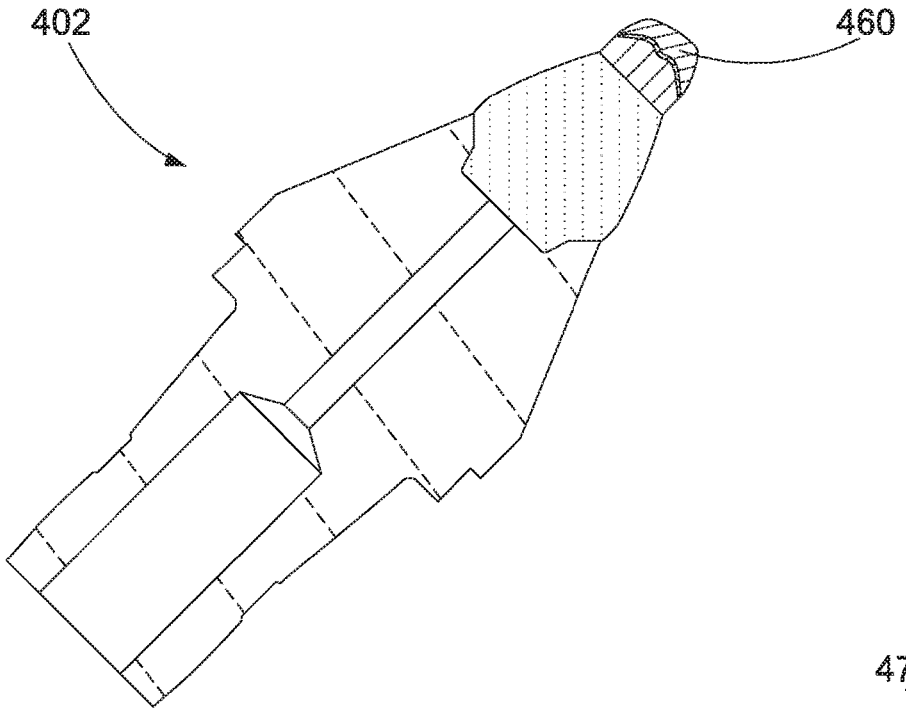
FIG. 4*a* is a longitudinal cross-sectional section view a pick with a cutting element on a tip thereof, according to additional embodiments of the present disclosure.
Figure 4B:
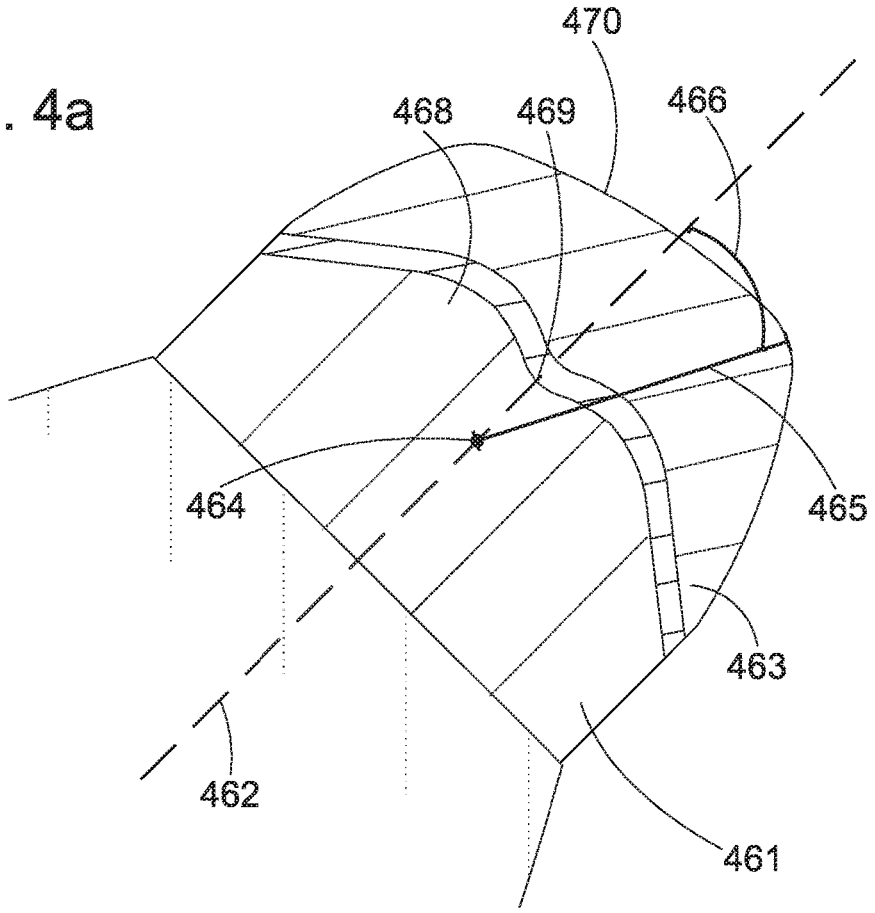
FIG. 4*b* is an enlarged view of the cutting element of FIG. 4*a*.

FIGS. 4*a* and 4*b* are cross-sectional views of another example embodiment of a pick 402 with a cutting element 460, which may be used in connection with tools and devices of the present disclosure. The cutting element 460 may include a super-hard material 463 bonded or otherwise coupled to a substrate 461 having a central axis 462 extending axially therethrough. For instance, the cutting element 460 may be secured to a distal end side, surface, or portion of the substrate 461.

In the illustrated embodiment, an external surface of the super-hard material 463 includes a ridge 470 that protrudes from the substrate 461 and which is optionally tapered or otherwise contoured over its length across a width of the cutting element 460. For instance, the ridge 470 may be generally convex over its maximum length. As can be seen in FIG. 4*b*, for example, a greatest distance 465 measured from the external surface of the super-hard material 463 to a central point 464 (identified at a position along the axis 462 at a distance from an external surface of the super-hard material 463 equal to a radius or half-width of the substrate 461) may be disposed at an angle 466 relative to the axis 462. In some embodiments, the angle 466 may be between 10° and 60°. For instance, the angle 466 may be within a range having lower, upper, or both lower and upper limits including any of 10°, 20°, 25°, 30°, 40°, 45°, 50°, 60°, and values therebetween. In particular examples, the angle 466 may be between 20° and 50°, between 25° and 45°, or between 30° and 40°. In still other embodiments, the angle 466 may be less than 25° or greater than 45°. In the illustrated embodiment, the greatest distance 465 is found at a single point on the surface of the super-hard material 463. In other embodiments, as discussed herein, the greatest distance 465 may be found at multiple points on the super-hard material 463.

Additionally, in the illustrated embodiment, the substrate 461 optionally includes an elevated portion 468 having a depression 469 therein. The depression 469 may be centered along the axis 462 in some embodiments, and may be symmetrical such that the substrate 461 is symmetrical about the axis 462. In other embodiments, the depression 469 may be asymmetric.

Figure 5A:
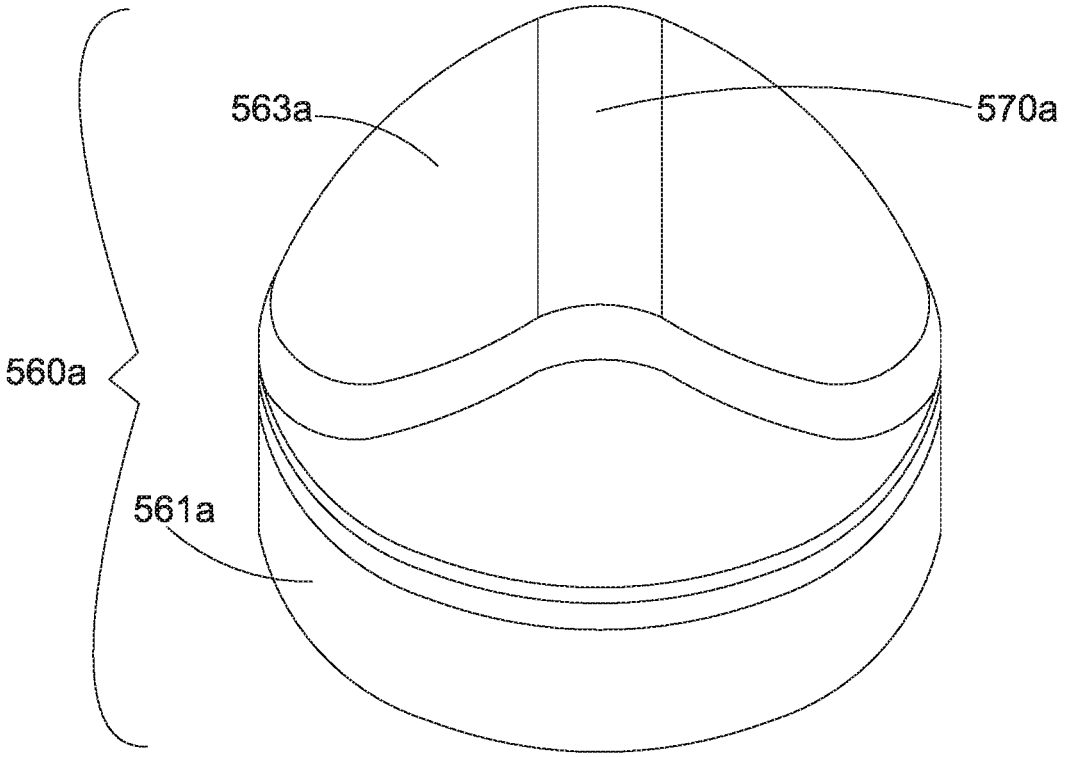
FIG. 5*a* is a perspective view of cutting element having a generally constant height ridge on the outer surface thereof, according to some embodiments of the present disclosure.
Figure 5B:
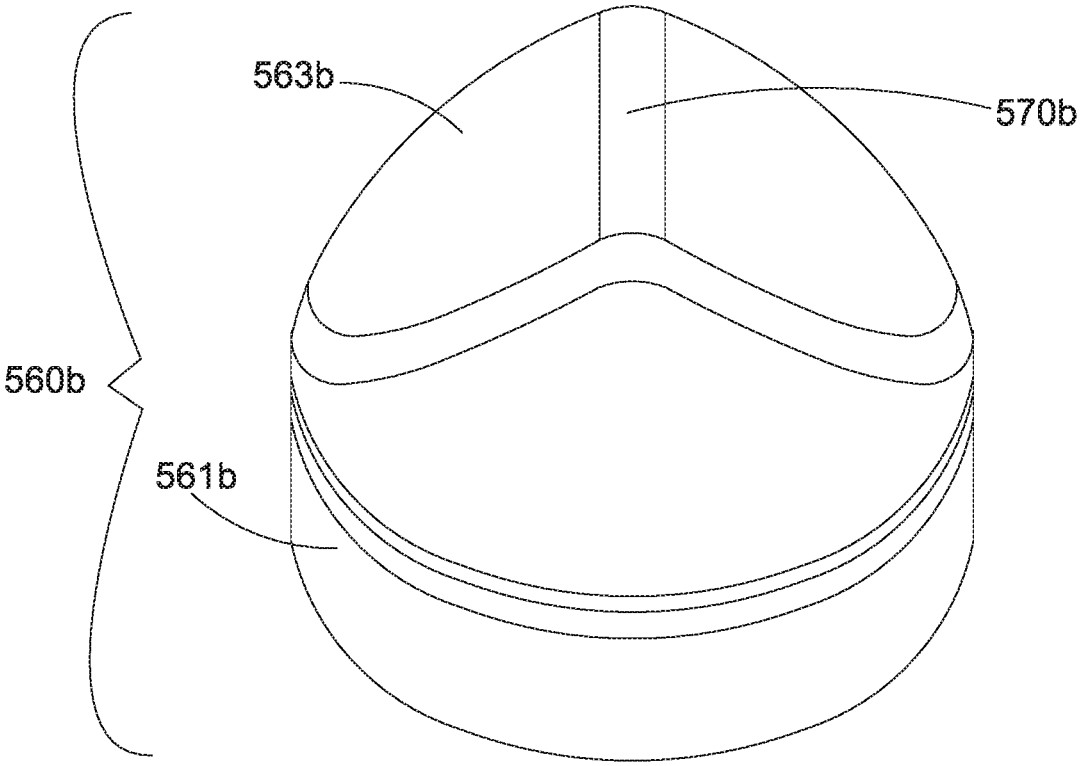
FIG. 5*b* is a perspective view of an embodiment of a cutting element having a convex ridge on the outer surface thereof, according to some embodiments of the present disclosure.

FIGS. 5*a* and 5*b* show embodiments of example cutting elements 560*a*, 560*b*. The geometry of cutting element 560*a* may be comparable to those shown in FIGS. 3*a* and 3*b*, while the geometry of cutting element 560*b* may be comparable to those shown in FIGS. 4*a* and 4*b*. As can be seen, both cutting elements 560*a* and 560*b* may include a super-hard material 563*a*, 563*b* bonded or otherwise coupled to a side (e.g., a distal end surface) of a substrate 561*a*, 561*b*. An external surface of the super-hard material 563*a*, 563*b* may include a ridge 570*a*, 570*b* protruding from a remainder of the external surface. The ridge 570*a* is shown as being of a generally constant height relative to the substrate 561*a*, while the ridge 570*b* may have a variable height relative to the substrate 561*b*.

Figure 6B:
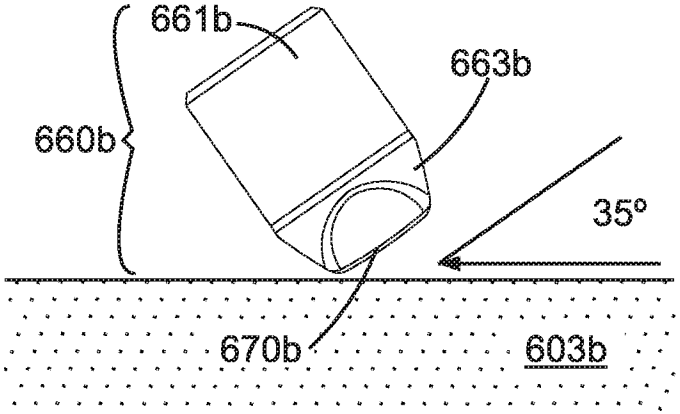
FIGS. 6*a*-6*d* are side views of cutting elements at various positions relative to a degradable material, according to some embodiments of the present disclosure.
Figure 6A:
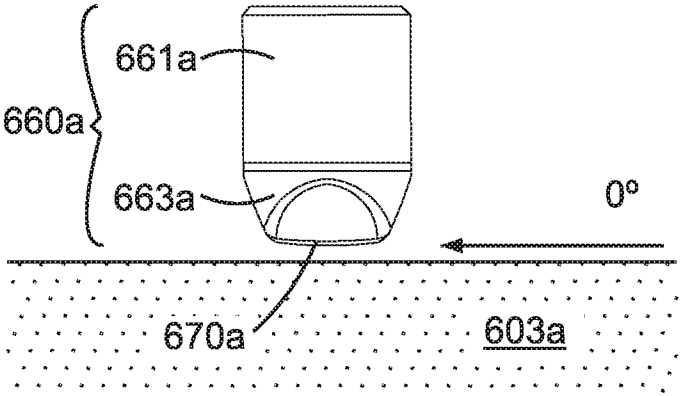
Figure 6C:
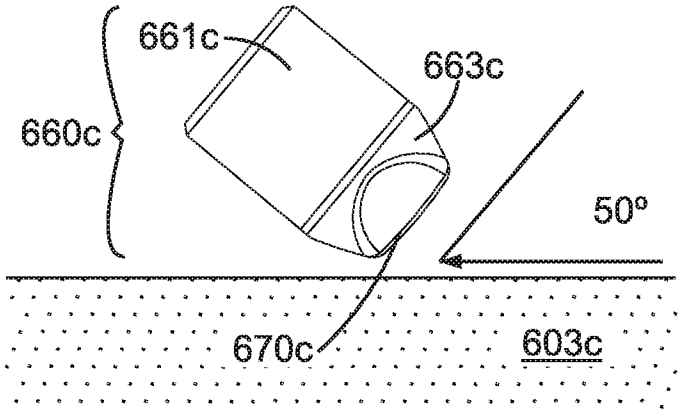
Figure 6D:
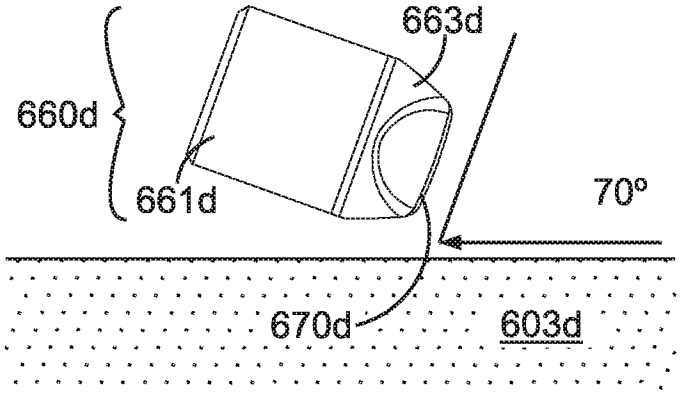

FIGS. 6*a*-6*d* show embodiments of cutting elements 660*a*-660*d*, respectively, at various positions relative to a formation, road surface, or other degradable material 603*a*-603*d*. Each of the cutting elements 660*a*-660*d* may include a super-hard material 663*a*-663*d* coupled to a substrate 661*a*-661*d*. Each super-hard material 663*a*-663*d* may have a ridge 670*a*-670*d* protruding from an external surface thereof. FIG. 6*a* shows cutting element 660*a* with a length of the ridge 670*a* extending in a direction oriented at 0° from, and substantially perpendicular to, a surface of the degradable material 603*a*. Further, a length of the ridge 670*b* in FIG. 6*b* is shown as extending in a direction oriented at 35° relative to the surface of the degradable material 603*b*, while a length of the ridge 670*c* of FIG. 6*c* is oriented at 50° from the surface of the degradable material 603*c*, and a length of the ridge 670*d* of FIG. 6*d* is oriented at 70° from the surface of the degradable material 603*d*. The position of the cutting element 660*a*-660*d* relative to the surface of a degradable material (e.g., road surface, formation, rock, etc.) may affect how much of each ridge is presented to the degradable material, and thus the aggressiveness of each cutting element. For example, with hard degradable materials, a ridge may be positioned less aggressively (i.e., at a lower angle) such that the degradable material rides up the ridge upon engagement until a sharp enough radius is obtained to degrade the material. This may prolong a useful life of such a cutting element. Accordingly, cutting elements as described herein may be secured to drill bits, picks, mining tools, or other cutting instruments and strategically placed and oriented to customize cutting aggressiveness, durability, and the like for specific locations or situations.

Figure 7:
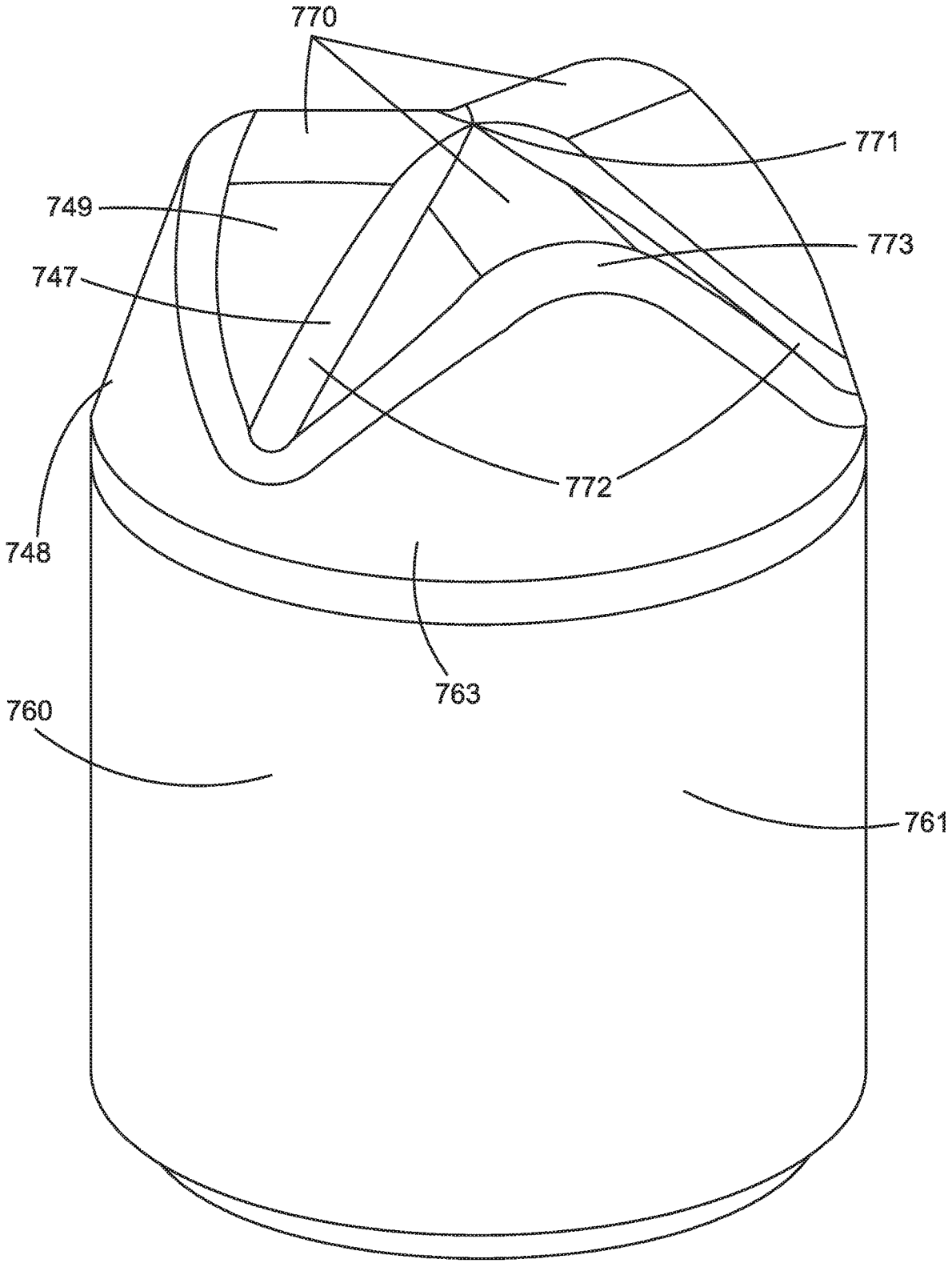
FIG. 7 is a perspective view of a cutting element including ridges extending from a common center, according to some embodiments of the present disclosure.
Figure 8:
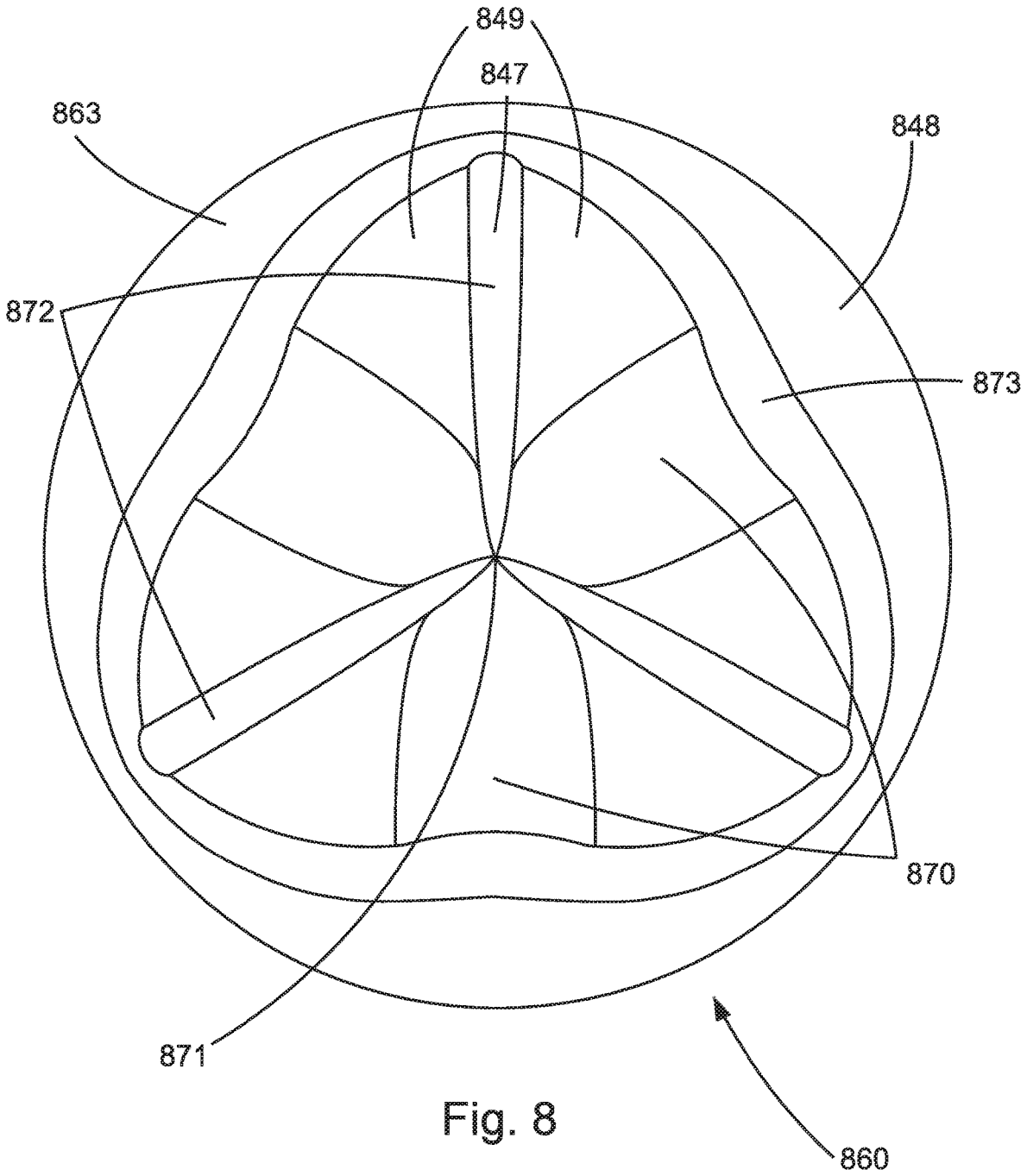
FIG. 8 is a plan view of a cutting element including ridges extending from a common center, according to some embodiments of the present disclosure.
Figure 9:
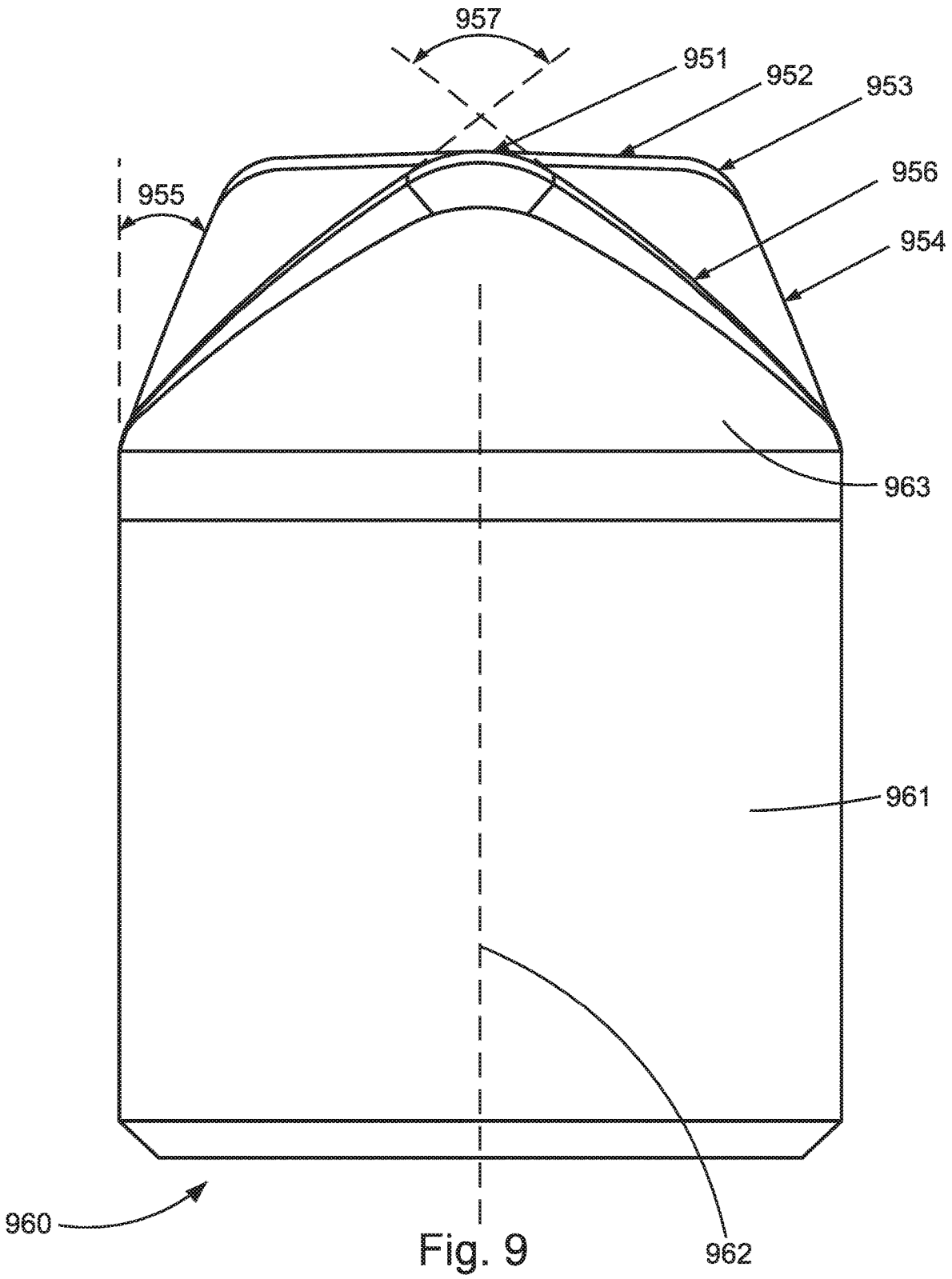
FIG. 9 is a side view of the cutting element including ridges extending from a common center, according to some embodiments of the present disclosure.

FIGS. 7-9 show embodiments of additional example embodiments of cutting elements 760, 860, and 960, respectively, which include a substrate 761, 961 with a super-hard material 763, 863, 963 coupled to one end thereof. In some embodiments, the super-hard material 763, 863, 963 may include a geometry arranged, designed, or otherwise configured to withstand high forces. The illustrated example geometry may include an external surface including multiple ridges 770, 870 extending radially outward from a common center 771, 871. In some embodiments, a depression 772, 872 may be located between each of the ridges 770, 870 and may extend axially toward the substrate 761, 961.

The substrate 761, 961 may have a substantially cylindrical shape, such that the common center 771, 871 lies on a central axis 962 of the cylindrical shape. The ridges 770, 870 may intersect the axis 962 and may be equally or unequally angularly spaced around the common center 771, 871. In some embodiments, the ridges 770, 870 may be generally perpendicular to the axis 962, angled at a non-perpendicular angel relative to the axis 962, or generally convex or concave over a maximum length thereof. Each of the ridges 770, 870 may have a radius of curvature 951. In some embodiments, the radius of curvature 951 may be between 0.02 inch (0.51 mm) to 0.35 inch (8.89 mm) when viewed along a length of the corresponding ridge (e.g., perpendicular to the axis 962). For instance, the radius or curvature 951 of a ridge may be within a range having a lower, upper, or both lower and upper limits including any of 0.02 inch (0.51 mm), 0.05 inch (1.27 mm), 0.10 inch (2.54 mm), 0.20 inch (5.08 mm), 0.25 inch (6.35 mm), 0.30 inch (7.62 mm), 0.35 inch (8.89 mm), or values therebetween. For instance, in some embodiments, the radius of curvature 951 of a ridge may be less than 0.25 inch (6.35 mm), greater than 0.05 inch (1.27 mm), between 0.03 inch (0.76 mm) and 0.30 inch (7.72 mm), between 0.05 inch (1.27 mm) and 0.25 inch (6.35 mm), or may be 0.105 inch (2.67 mm). In other embodiments, the radius or curvature 951 of a ridge may be less than 0.02 inch (0.51 mm) or greater than 0.35 inch (8.89 mm).

In some embodiments, one or more ridges 770, 870 may further have an additional radius of curvature 952 when viewed perpendicular to the length of the ridge 770, 879, and perpendicular to the axis 952. The radius or curvature 952 may, in some embodiments, be convex or concave, and may be between 0 inch (0 mm) and 5 inches (127 mm). For instance, For instance, the radius or curvature 952 of a ridge may be within a range having a lower, upper, or both lower and upper limits including any of 0.000 inch (0.00 mm), 0.025 inch (0.64 mm), 0.050 inch (1.27 mm), 0.075 inch (1.91 mm), 0.100 inch (2.54 mm), 0.200 inch (5.08 mm), 0.500 inch (12.7 mm), 1.000 inch (25.4 mm), 2.500 inches (63.5 mm), 5.000 inches (127 mm), or values therebetween. For instance, in some embodiments, the radius of curvature 952 of a ridge may be less than 3.000 inches (76.2 mm), greater than 0.075 inch (1.91 mm), between 0.050 inch (1.27 mm) and 4.000 inches (101.6 mm), between 0.075 inch (1.91 mm) and 3.000 inches (76.2 mm), or may be 1.790 inches (45.47 mm). In other embodiments, the radius or curvature 952 of a ridge may greater than 5 inches (127 mm).

In some embodiments, the super-hard material 763, 863, 963 may include a generally conical or ogive periphery 748, 848. The periphery 748, 848 may be positioned, for instance, radially beyond a position between 25° and 45° from the axis 962, although the periphery 748, 848 may be positioned less than 25° or greater than 45° from the axis 962 in other embodiments. The periphery 748, 848 may narrow in a direction extending from adjacent the interface between the substrate 761, 961 and the super-hard material 763, 863, 963 toward a distal end of the super-hard material 763, 863, 963. A boundary between each of the ridges 770, 870 and the periphery 748, 848 may, in some embodiments, include a transition such as a fillet, round, or chamfer 773, 873. One or more, and potentially each, of the ridges 770, 870 may optionally include an arched exterior culminating at a generally planar surface or linear edge, and curving on either side of each ridge toward the substrate 761, 961. Further, each arched exterior may include a similar radius of curvature relative to the radius of curvature of each other arched exterior. The ridges 770, 870 may extend from the common center 771, 871 to the periphery 748, 848 where a transition may connect each of the ridges 770, 879. The transition between each of the ridges 770, 870 and the periphery 748, 848 may include a chamfer, although in some embodiments the transition may be curved. For instance, a radius of curvature 953 between a ridge 770, 870 and the periphery 748, 848 may be between 0.020 inch (0.51 mm) and 0.150 inch (3.81 mm) when viewed perpendicular to a ridge and perpendicular to the axis 962, as shown in FIG. 9. For instance, the radius or curvature 953 may be 0.050 inch (1.27 mm). In other embodiments, the radius of curvature 953 may be less than 0.02 inch (0.51 mm) or greater than 0.15 inch (3.81 mm).

The periphery 748, 848 itself may be linear, or may include a concave or convex radius of curvature 954. In some embodiments, the radius of curvature may be convex and may be between 0.075 inch (1.91 mm) to 3.000 inches (76.2 mm) when viewed perpendicular to a ridge and perpendicular to the axis 962, as shown in FIG. 9. For instance, the radius of curvature 954 may be 1.890 inches (48.01 mm). Such values are illustrative, as in other embodiments the radius of curvature 954 may be less than 0.075 inch (1.91 mm) or greater than 3.000 inches (76.2 mm).

Further, when viewed in cross-section or as a side view, the periphery 748, 848 may extend at an angle 955 relative to the axis 962, as seen in FIG. 9 in which the view is perpendicular to the length of the ridge and perpendicular to the axis 962. Where the periphery 748, 848 has a linear taper, the angle 955 may be determined based on the angle of the linear edge relative to the axis 962. Where the periphery 748, 848 has a curved taper, the angle 955 may be determined based on a line through the starting and end points of the curved taper relative to the axis 962. In some embodiments, the angle 955 may be between 2.5° and 60°. For instance, the angle 955 may be within a range having lower, upper, or both lower and upper values that include any of 2.5°, 5°, 10°, 20°, 30°, 35°, 40°, 45°, 50°, 60°, or values therebetween. In particular examples, the angle 955 may be between 2.5° and 45°, between 5° and 35°, or between 17° and 27°. For instance, the angle 955 may be 22°. In other embodiments, the angle 955 may be less than 2.5° or greater than 60°.

In the embodiments shown in FIGS. 7-9, one or more, and potentially each, of the depressions 772, 872 between ridges 770, 870 may include a center furrow 747, 847 that is optionally equidistant from adjacent ridges 770, 870. The depressions 772, 872 may be symmetrical about their respective furrow 747, 847, with surfaces 749, 849 on either side of each furrow 747, 847 extending toward adjacent ridges 770, 870. Such surfaces 749, 849 may retreat gradually from either side of each ridge until they meet the periphery 748, 848. In other embodiments, the depressions 772, 872 may be asymmetrical about their respective furrow 747, 847.

In some embodiments, the surfaces 749, 849 leading up to each of the adjacent ridges 770, 870 may define or have a radius of curvature 956 when viewed along a ridge perpendicular to the axis 962. According to at least some embodiments, the radius of curvature 956 may be between 0.050 inch (1.27 mm) and 3.000 inches (76.2 mm), or between 0.500 inch (12.7 mm) and 2.000 inches (50.8 mm). For instance, the radius of curvature 956 may be 1.000 inch (25.4 mm). In other embodiments, the radius of curvature 956 may be less than 0.05 inch (1.27 mm) or greater than 3.000 inches (76.2 mm).

In some further embodiments, the surfaces 749, 849 on either side of a furrow 747, 847 may form an angle 957 with a surface opposite each of the ridges 770, 870 when viewed along the ridge and perpendicular to the axis 962, as shown in FIG. 9. The angle 957 may, in some embodiments, be between 70° and 160°, or between 95° and 115°. For instance, the angle 957 may be between 100° and 105°. In other embodiments, the angle 957 may be less than 70° or greater than 160°.

As shown, each of the depressions 772, 872 may diverge from adjacent ridges 770, 870 and extend a similar depth toward the substrate 761, 961. In addition, each of the furrows 747, 847 may extend radially outwardly from the common center 771, 871 and extend further toward the substrate 761, 961 in a radially outward direction. In other embodiments, one or more depressions 772, 872 may have a different depth, or a furrow 747, 847 may extend radially inwardly at one or more locations along a length thereof.

Figure 10:
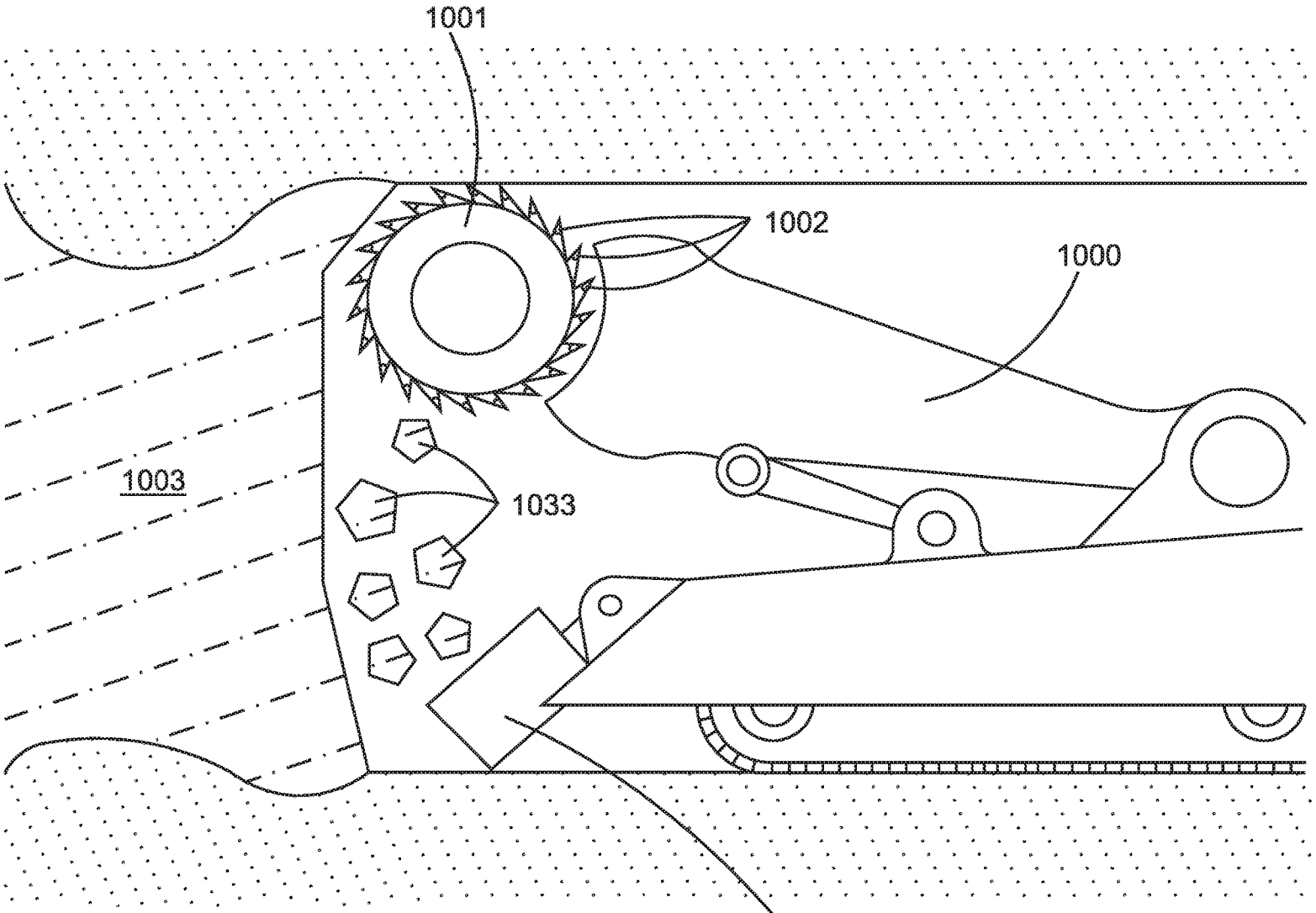
FIG. 10 is a side view of a mining machine performing a mining operation, according to some embodiments of the present disclosure.

FIG. 10 is a side view of a mining machine 1000 performing an example mining operation that may be used when extracting valuable materials, such as coal, from the earth. The mining machine 1000 may include a plurality of picks 1002 coupled to a rotatable drum 1001 similar to that shown in FIG. 2. As the rotatable drum 1001 rotates, the picks 1002 may engage and degrade a potentially valuable material 1003 that forms aggregate 1033. The aggregate 1033 may be removed by a conveyor 1009. Each of the plurality of picks 1002 may include a cutting element such as those described herein, including a cutting element with one or more ridges protruding therefrom. Such ridges may be aligned with the direction of rotation of the rotatable drum 1001. Such alignment may allow the cutting elements to withstand higher forces in various applications.

Figure 11A:
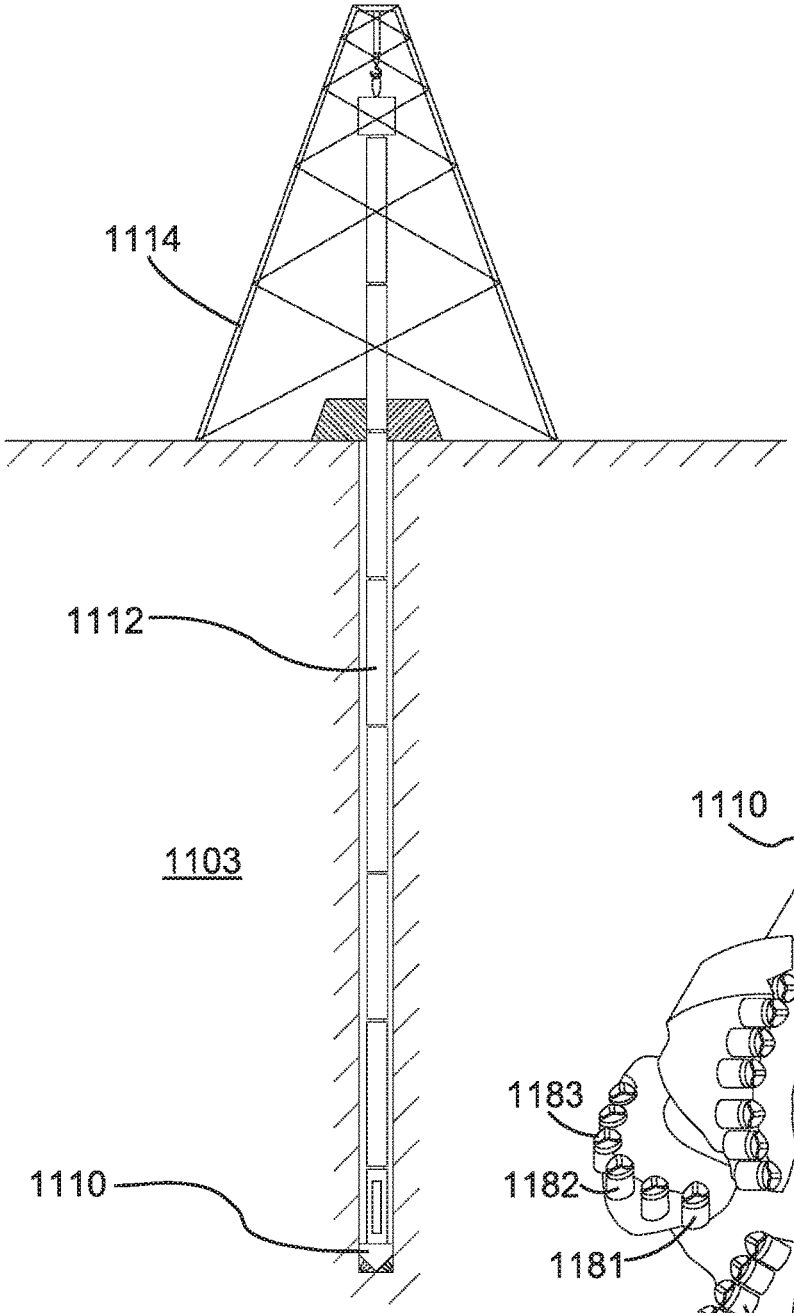
FIG. 11*a* is schematic view of a drilling system for use in performing an earth-boring operation, according to some embodiments of the present disclosure.

FIG. 11*a* schematically illustrates an example drilling system used in an earth boring operation used to explore for or extract subterranean oil, gas, or geothermal energy deposits from the earth. In such operations, a drill bit 1110 may be coupled to an end of a drill string 1112 suspended from a derrick 1114. The derrick 1114 may rotate the drill string 1112 causing the drill bit 1110 to advance into an earthen formation 1103.

Figure 11B:
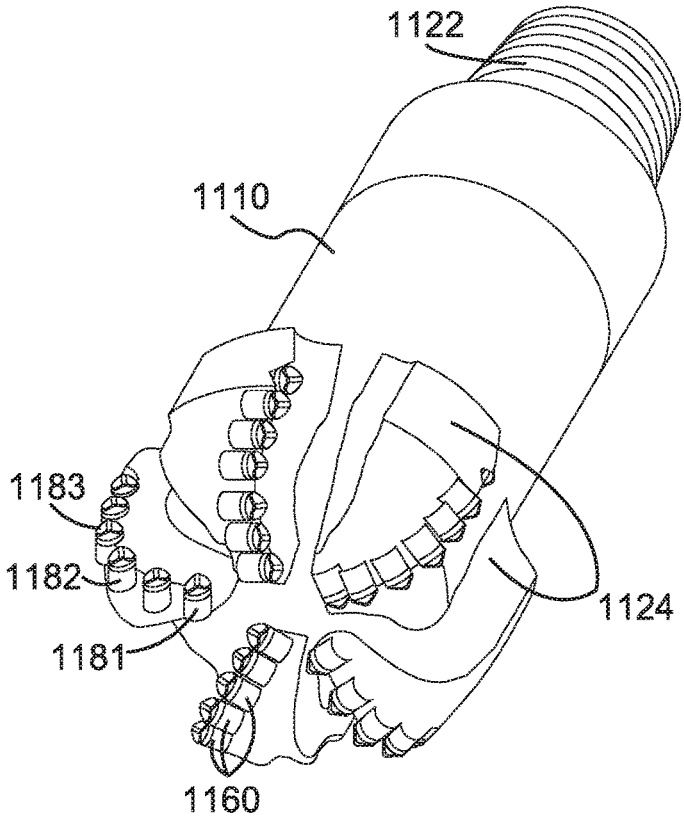
FIG. 11*b* is a perspective view of an example drill bit having cutting elements thereon, and which can be used in the drilling system of FIG. 11*a*.

FIG. 11*b* shows an example PDC, or "drag" drill bit 1110 including a threaded pin 1122 for connection to the drill string 1112. The drill bit 1110 may further have a plurality of blades 1124 protruding from a distal end opposite the threaded pin 1122. The blades 1124 and the distal end of the drill bit 1110 may define a bit face, and a plurality of cutting elements 1160 may be secured to the blades 1124 on the bit face of the drill bit 1110. The cutting elements 1160 may be positioned such that as the drill bit 1110 rotates, the cutting elements 1160 degrade the earthen formation 1103 to form or extend a wellbore in the earthen formation 1103. Some or each of the cutting elements 1160 may include a ridge protruding therefrom. Such ridges may be aligned with the direction of rotation of the drill bit 1110, which may allow the cutting elements to withstand higher forces in many applications. In other applications, the cutting elements 1160 may be secured to the drill bit 1110 such that the ridge is positioned parallel, non-parallel, or perpendicular to a direction of rotation of the drill bit. For example, cutting element 1181 may be positioned relatively parallel to a direction of rotation, cutting element 1183 may be positioned relatively perpendicular to a direction of rotation, while cutting element 1182 may be positioned somewhere in between. Such positioning may affect how much of each ridge is presented to a formation and thus the aggressiveness of each cutting element. This may prolong a useful life of such cutting elements. Accordingly, cutting elements as described herein may be secured to drill bits or picks strategically to customize operation, durability, use, or the like at specific locations or for specific situations.

Figure 12A:
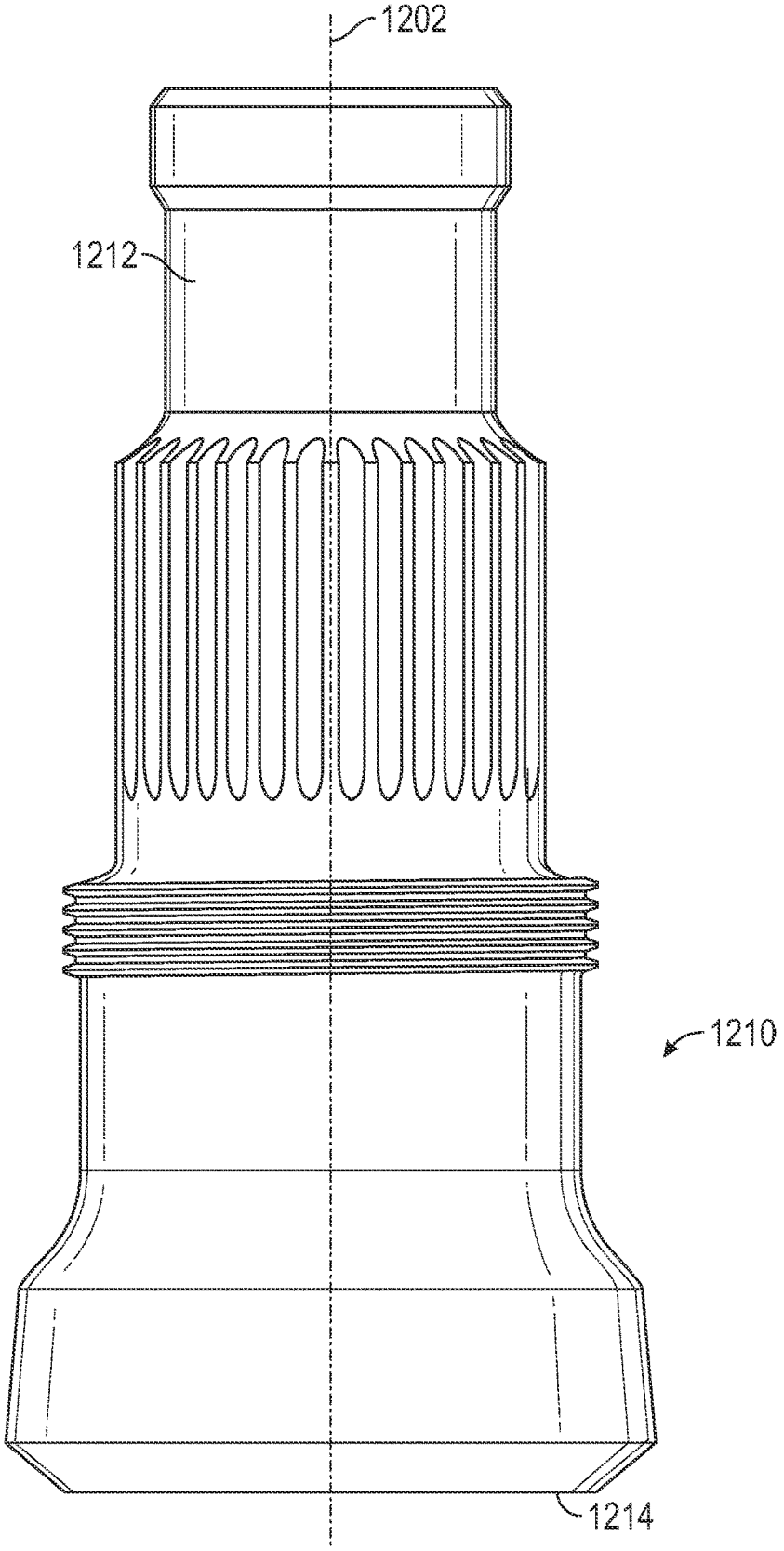
FIG. 12*a* is a side view of a percussion hammer bit, according to some embodiments of the present disclosure.
Figure 12B:
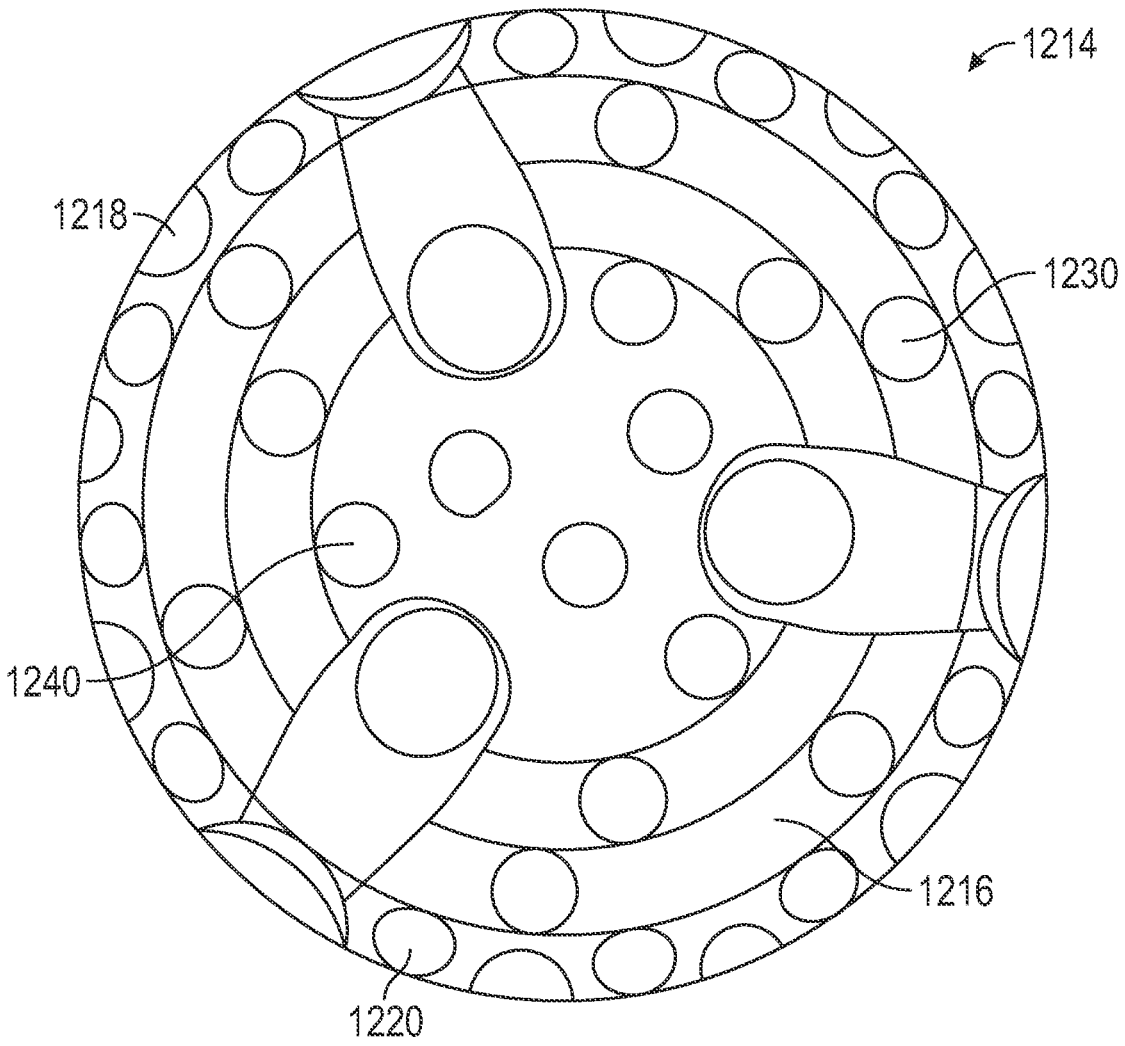
FIG. 12*b* is a plan view of the percussion hammer bit of FIG. 12*a*, which shows the bit face thereof.

FIG. 12*a* is a side view of an example percussion drill bit 1210 including an attachment end 1212 for connection to a drill string such as drill string 1112 illustrated in FIG. 11*a*. Opposite the attachment end 1212, the percussion drill bit has a bit face 1214 for impacting and breaking up a formation. A central bit axis 1202 runs from the attachment end 1202 to the bit face 1214. An example of the bit face 1214 is further illustrated in FIG. 12*b* which depicts the bit face 1214 of the percussion hammer bit 1210 having a plurality of cutting elements or inserts 1220, 1230, and 1240 coupled thereto. The bit face 1214 may include a center region 1216 and a gage region 1218, according to some embodiments of the present disclosure. In such embodiments, the gage region 1218 is located around the periphery of the bit face 1214, and generally corresponds to the maximum size or diameter of the bit face 1214. In some embodiments, the gage region 1218 fully or partially surrounds the center region 1216. In some embodiments, the gage region 1218 includes a single row of inserts around the periphery of the bit face 1214, while in other embodiments, the gage region 1218 may include multiple rows (e.g., a gage row, and an adjacent-to-gage row).

Figure 16:
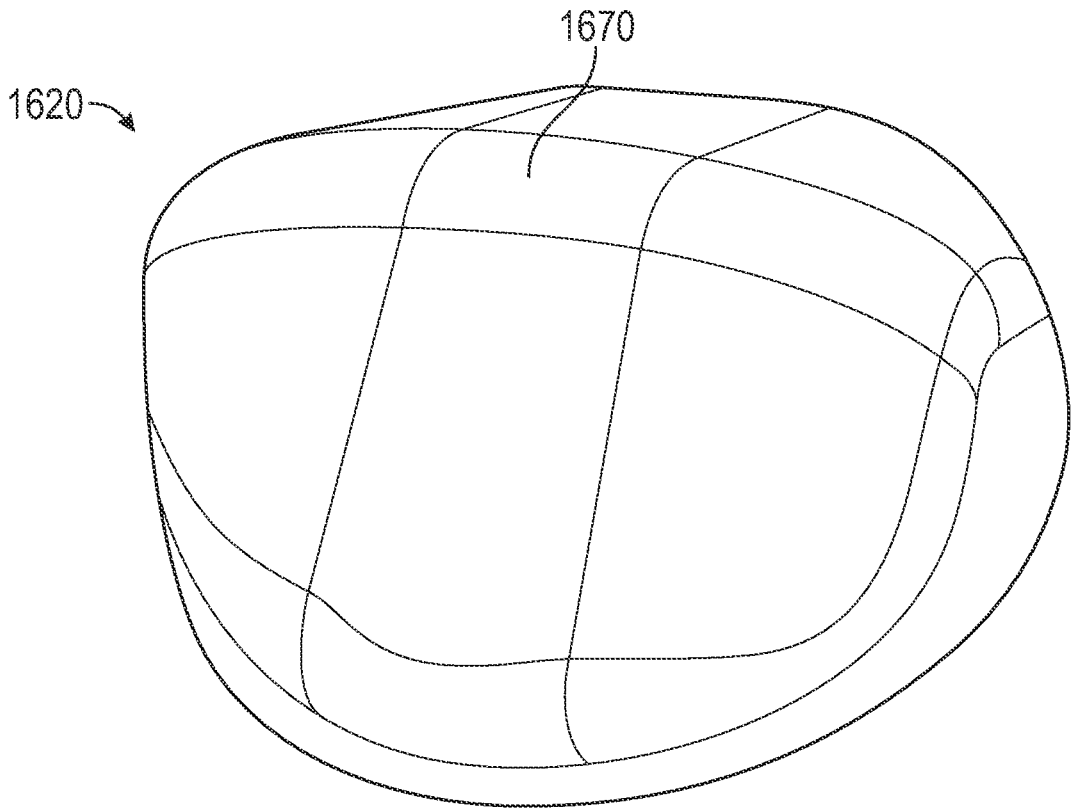
FIG. 16 is a perspective view of a bow chisel-type cutting element having a ridge with flat and curved sections, according to some embodiments of the present disclosure.

Any number of cutting elements or inserts 1220, 1230, and 1240 may be coupled to, or otherwise disposed on the bit face 1214, and the elements 1220, 1230, and 1240 may be arranged in any number of manners, configurations, patterns, and the like. Moreover, the inserts 1220, 1230, and 1240 themselves may have any number of different shapes, forms, constructions, or other characteristics. In some embodiments, the inserts 1220 are chisel-type inserts. Embodiments of chisel-type cutters 1220 are shown in and described with respect to FIGS. 3*b*, 4*b*, 5*a*, 5*b*, 6*a*-6*d*, 7-9, 15*a*-15*d*, and 16. FIGS. 15*a*-15*d* illustrate multiple perspective views of a vaulted chisel-type insert 1520, according to one embodiments of the present disclosure. A vaulted chisel-type insert 1520 may be similar to the insert shown in and described with respect to FIG. 3*b*, and may include a convex curvature in the ridge portion 1570. FIG. 16 illustrates a perspective view of a bow chisel-type insert 1620, which is similar to the insert shown in and described with respect to FIG. 3*b*, and may include a ridge portion 1670 that includes flat and curved sections, according to some embodiments of the present disclosure.

Figure 13:
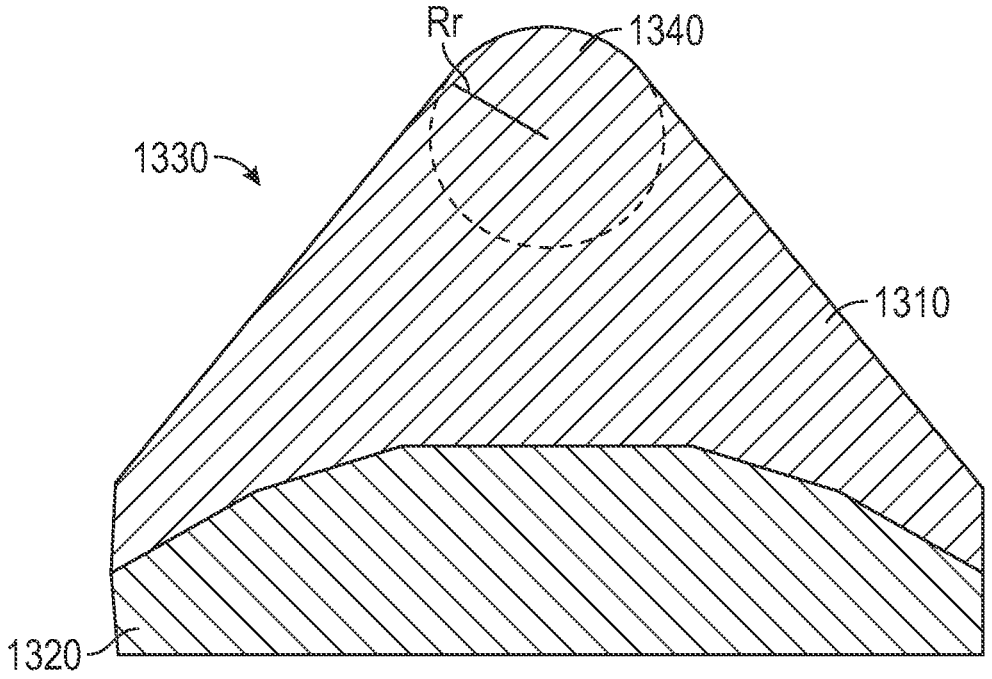
FIG. 13 is a cross-sectional view of a pointed cutting element, according to some embodiments of the present disclosure.

In some embodiments, inserts 1230 are pointed-type (e.g., conical) cutting elements. FIG. 13 illustrates a cross-sectional view of a pointed cutting element 1330, according to some embodiments of the present disclosure. In at least some embodiments, pointed cutting elements 1330 may include an ultra-hard material 1310 on a substrate 1320, and the ultra-hard portion 1310 may include at least one apex 1340 having a small radius of curvature Rr.

Figure 14:
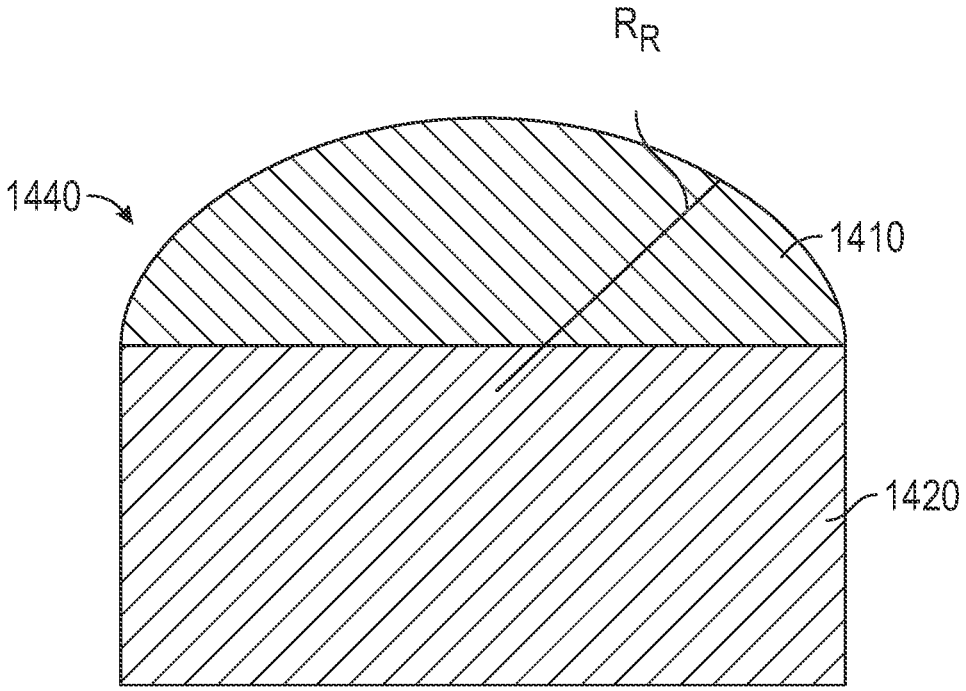
FIG. 14 is a cross-sectional view of a domed-type cutting insert, according to some embodiments of the present disclosure.
Figure 15A:
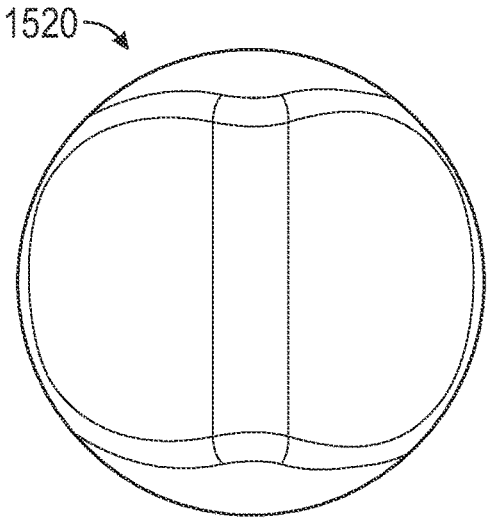
FIGS. 15*a*-15*d* are perspective views of a vaulted chisel-type cutting element, according to some embodiments of the present disclosure.
Figure 15B:
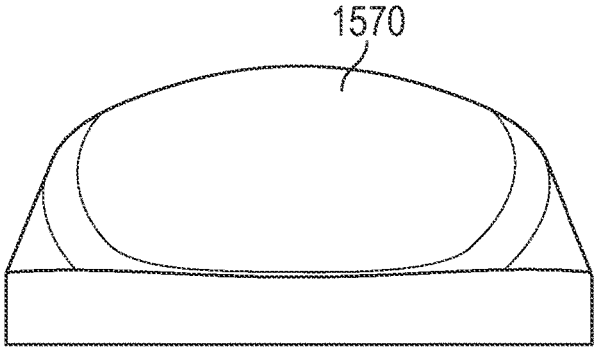
Figure 15C:
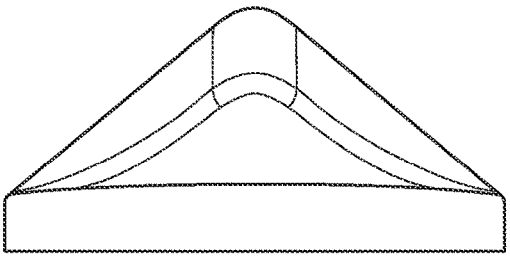
Figure 15D:
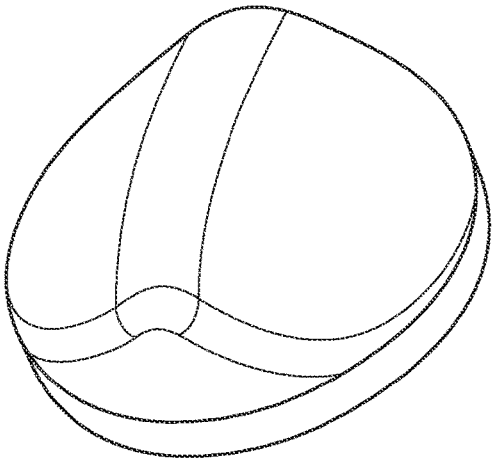

In some embodiments, inserts 1240 are domed inserts. FIG. 14 is a cross-sectional view of a domed-type insert 1440, according to some embodiments. Insert 1440 may comprise an ultra-hard layer 1410 and a substrate 1420, as illustrated, or it may contain more or fewer ultra-hard layers. In some embodiments, domed inserts 1440 include an ultra-hard layer 1410 or other outer layer or surface having a large radius of curvature RR.

In some embodiments, the center region 1220 of the bit 1210 includes at least one pointed cutting element 1230. A pointed cutting element in the center region may bear on-axis impact on the small-radius cutting tip to crush and gouge the formation. Domed-type inserts 1240 may be found within the center region, the gage region, both, or neither.

In some embodiments, gage region 1218 may include at least one chisel-type cutting element 1220. A chisel-type cutting element may have durability similar to domed inserts, but with increased crushing, penetration, and cutting efficiency. A chisel-type insert may allow for a sharper radius to cut in the forward direction of the bit, and may further have a sharp radius to cut the gage or at the side of the bit. In addition, a chisel-type cutting element may exhibit increased resistance to off-axis impact forces, such as those that may be experienced in the gage region, as compared to pointed-type cutting elements.

The cutting element(s) 1220 may be oriented within the gage region for maximum impact resistance and rock fragmentation. For example, the cutting element 1220 may be rotated to orient the ridge or chisel feature perpendicular to the direction of rotation of the drill bit. In other embodiments, the chisel/ridge may be oriented at an angle that is not perpendicular to the direction of rotation, such as at +/−45° relative to the direction of rotation and/or the formation hole wall. Combinations of orientations of multiple chisel-type cutters in the gage region may help promote crack formation or cause larger chip to be removed by the cutters. For example, chisel-type cutters may be oriented at alternating +θ degrees/−θ degrees, where $0<\theta<90$ (forming a "W" type pattern), which may facilitate more efficient crack formation and crack propagation with the crack tips intersecting to form large chips.

Figure 12C:
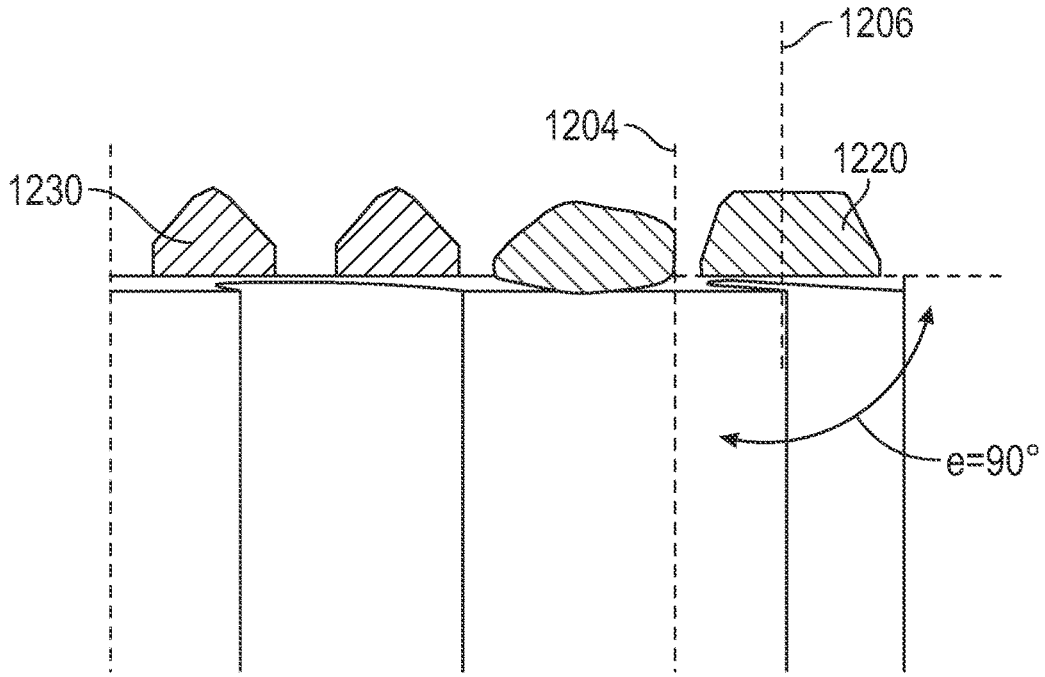
FIGS. 12*c* and 12*d* are perspective side views of the bit face of the percussion hammer bit of FIGS. 12*a* and 12*b*.
Figure 12D:
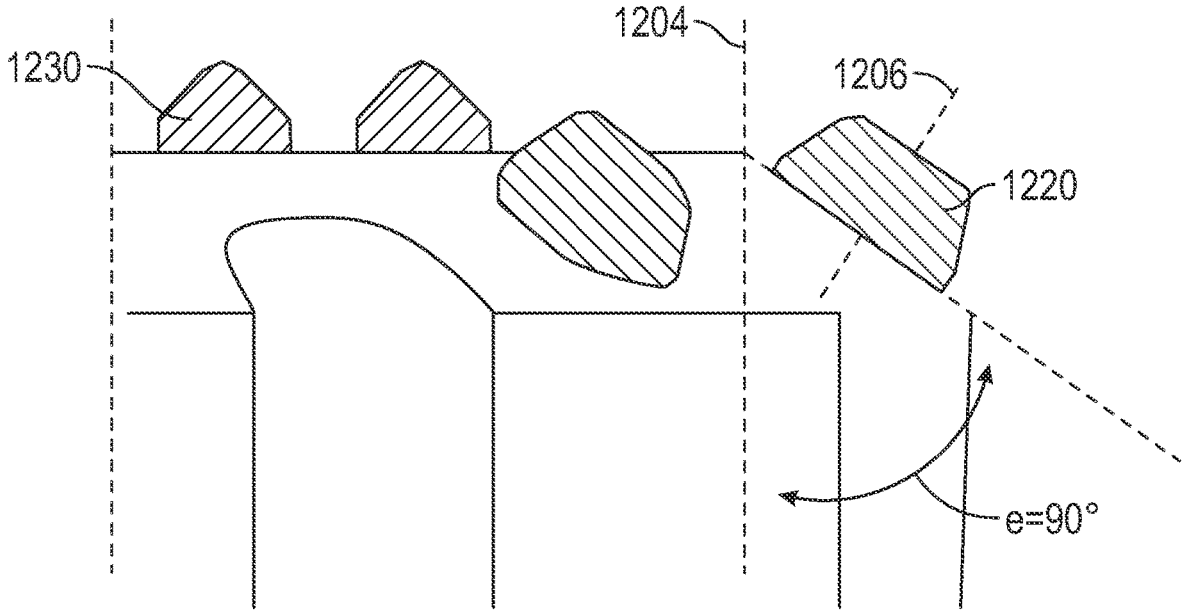

In the same or other embodiments, a ridge or chisel type insert 1220 may be tilted so that the axis of the insert is not parallel to the bit axis. FIGS. 12*c* and 12*d* illustrate perspective side views of the bit face 1214, according to some embodiments of the present disclosure. In FIG. 12*c*, ridge cutting element 1220 is located in the gage region 1218, and pointed cutting element 1230 is located in the center region 1216. The surface of the gage region 1218 may be about perpendicular to a line 1204 parallel to the central axis 1202 of drill bit 1210, so that an axis 1206 of cutting element 1220 is about parallel to a line 1204, which is parallel to the bit axis 1202. In FIG. 12*d*, the chisel/ridge cutting element 1220 is located in gage region 1218, and a pointed cutting element 1230 is located in the center region 1216. In some embodiments, a full or partial portion of the surface of the gage region 1218 may be angled and non-parallel and non-perpendicular with respect to the line 1204 parallel to central axis 1202. For example, at least a portion of the surface of gage region 1218 may be angled less than 90° with respect to the central axis 1202. The angle of the surface of gage region 1218 allows an axis 1206 of insert 1220 to be tilted with respect to central bit axis 1202. The unique shape of chisel-type cutters create impact resistance to both top impact and side impact forces, increasing the operational life of the insert and thereby the drill bit.

In some embodiments, the center region of the bit face includes a plurality of pointed-type elements, and the gage region includes a plurality of chisel-type elements. This configuration may provide increased rate of penetration (ROP) relative to using smaller-radius pointed inserts or larger-radius domed inserts, as crushing and penetration can be increased while durability can be maintained by including chisel cutters in regions where inserts may experience greater off-axis loads. In some embodiments, pointed-type cutters are used in areas that experience primarily on-axis loads, while chisel-type cutters are used in areas that experience off-axis loads.

While embodiments of cutting elements and cutting tools have been primarily described with reference to drilling, road milling, and mining operations, the devices described herein may be used in applications other than the drilling, mining, or road milling. In other embodiments, cutting elements and cutting tools according to the present disclosure may be used outside a wellbore, mining, or road milling environment. For instance, tools and assemblies of the present disclosure may be used in a wellbore used for placement of utility lines, in a medical procedure (e.g., to clear blockages within an artery), in a manufacturing industry (e.g., to expand a diameter of a bore within a component), in other industries (e.g., aquatic, automotive, etc.), or in a wellbore enlargement application (e.g., with an underreamer).

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value. Where a range of values includes various lower or upper limits, any two values may define the bounds of the range, or any single value may define an upper limit (e.g., up to 50%) or a lower limit (at least 50%).

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements. It should be understood that "proximal," "distal," "uphole," and "downhole" are relative directions. As used herein, "proximal" and "uphole" should be understood to refer to a direction toward the surface, rig, operator, or the like. "Distal" or "downhole" should be understood to refer to a direction away from the surface, rig, operator, or the like. When the word "may" is used herein, such term should be interpreted as meaning that the identified feature, function, characteristic, or the like is present in some embodiments, but is optional and not present in other embodiments.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope. Features of various embodiments described herein may be used in combination, except to the extent such features are mutually exclusive.

The invention claimed is:

1. A cutting element, comprising:

a substrate that is axially symmetric about a central axis thereof, the substrate having a radius that is perpendicular to the central axis and which extends from the central axis to an outer surface of the substrate;

a super-hard material body coupled to the substrate such that the central axis passes through the super-hard material body, the super-hard material having an external surface defining at least one ridge protruding from a remainder of the external surface, the at least one ridge having an outer edge that is generally linear, wherein the super-hard material body is formed from polycrystalline diamond; and a central point on the central axis, the central point on the central axis offset from the external surface of the super-hard material body by a first distance equal to the radius of the substrate, a second distance measured from the external surface of the super-hard material body to the central point being greatest at a position between 25° and 45° from the central axis of the substrate, the second distance being larger than the first distance, and the distance measured from the external surface of the super-hard material body to the central point being greatest at more than one position on the external surface of the super-hard material body.

2. The cutting element of claim 1, the at least one ridge being perpendicular to the central axis of the substrate.

3. The cutting element of claim 1, the at least one ridge being generally convex over a length thereof.

4. The cutting element of claim 1, the at least one ridge including a plurality of ridges extending from a common center of the external surface.

5. The cutting element of claim 4, the common center being on the central axis of the substrate and the plurality of ridges being equally spaced around the common center.

6. The cutting element of claim 1, at least a portion of the external surface of the super-hard material body radially beyond a position between 25° and 45° from the central axis of the substrate from the central point forming part of a cone or ogive shape.

7. The cutting element of claim 6, the portion of the external surface forming part of the cone shape forming an angle between 5° and 35° with the central axis of the substrate, when viewed perpendicular to a length of the at least one ridge and perpendicular to the central axis of the substrate.

8. The cutting element of claim 6, a boundary between the at least one ridge and the part of the cone shape or ogive shape including a chamfer.

9. The cutting element of claim 1, the external surface forming an angle between 70° and 160° as the external surface retreats on either side of the at least one ridge, when viewed along a length of the at least one ridge and perpendicular to the central axis of the substrate.

10. The cutting element of claim 1, a transition zone at an interface between the super-hard material body and the substrate having a substantially constant thickness regardless of the thickness of the super-hard material body.

11. The cutting element of claim 1, the at least one ridge including a radius of curvature between 0.050 inch and 0.250 inch, when viewed along the ridge and perpendicular to the central axis of the substrate.

12. The cutting element of claim 1, the substrate being coupled to a drill bit or pick.

13. The cutting element of claim 1, the central point being located in the substrate.

14. A cutting element, comprising:

a substrate including:

a substrate radius, the substrate radius being measured from a longitudinal axis to an outer surface of the substrate, the substrate being formed from a carbide material;

a distal surface; and an elevated portion extending from the distal surface; and a ridge body protruding from and bonded to the distal surface to thereby form an interface, an external surface of the ridge body defining at least one ridge having an outer edge that is generally linear, the longitudinal axis extending through the at least one ridge of the ridge body, the ridge body being formed of polycrystalline diamond of a variable thickness relative to the interface, and the elevated portion protruding into the at least one ridge, wherein at a central point within the cutting element and offset from the external surface of the ridge body along the longitudinal axis by the substrate radius, a distance from the central point to the external surface of the ridge body on the at least one ridge increases from when aligned with the longitudinal axis to be greatest at an angle between 25° and 45° from the longitudinal axis, and wherein the variable thickness of the ridge body, measured from the external surface of the ridge body to the interface along a line passing through the central point, has a greatest value at the position between 25° and 45° from the longitudinal axis of the substrate.

15. The cutting element of claim 14, the elevated portion including a depression at the central axis of the substrate.

16. The cutting element of claim 14, the elevated portion extending radially to a position between 25° and 45° from the longitudinal axis of the substrate from the central point.

17. The cutting element of claim 14, wherein a radial line perpendicular to the longitudinal axis extends through at least a portion of the elevated portion and the ridge body.

* * * * *